US012742402B2

(12) United States Patent
Kline et al.

(10) Patent No.: US 12,742,402 B2
(45) Date of Patent: Sep. 22, 2026

(54) HEAT ENGINE USING A LIQUID-VAPOR-PHASE-CHANGING MATERIAL

(71) Applicants: TECHNION RESEARCH & DEVELOPMENT FOUNDATION LIMITED, Haifa (IL); LAVA ENERGY LTD, Haifa (IL)

(72) Inventors: Erez Kline, Ramat Gan (IL); Yuval Neumann, Kfar Saba (IL); Doron Tamir, Beit Yanai (IL); Carmel Rotschild, Ganei Tikva (IL); Joseph Cassell, Netanya (IL)

(73) Assignees: TECHNION RESEARCH & DEVELOPMENT FOUNDATION LIMITED, Haifa (IL); LAVA ENERGY LTD, Haifa (IL)

( * ) Notice: Subject to any disclaimer, the term of this patent is extended or adjusted under 35 U.S.C. 154(b) by 0 days.

(21) Appl. No.: 19/100,487

(22) PCT Filed: Aug. 3, 2023

(86) PCT No.: PCT/IL2023/050808

§ 371 (c)(1),
(2) Date: Jan. 31, 2025

(87) PCT Pub. No.: WO2024/028878

PCT Pub. Date: Feb. 8, 2024

(65) Prior Publication Data

US 2026/0043340 A1 Feb. 12, 2026

Related U.S. Application Data

(60) Provisional application No. 63/370,400, filed on Aug. 4, 2022, provisional application No. 63/478,232, filed (Continued)

(51) Int. Cl.
*F01K 27/00* (2006.01)
*F01K 25/06* (2006.01)

(52) U.S. Cl.
CPC ..... *F01K 27/00* (2013.01); *F01K 25/06* (2013.01)

(58) Field of Classification Search
CPC ..... F01K 27/00; F01K 25/06
See application file for complete search history.

(56) References Cited

U.S. PATENT DOCUMENTS 3,879,949 A * 4/1975 Hays ..... B01D 19/0052 416/197 R
3,972,195 A * 8/1976 Hays ..... F01K 25/04 60/671

(Continued)

FOREIGN PATENT DOCUMENTS

WO 2022/049573 A2 3/2022
WO 2022/234554 A1 11/2022

OTHER PUBLICATIONS

Singh, S. et al., "Thrust Enhancement Through Bubble Injection Into an Expanding-Contracting Nozzle With a Throat," J. Fluids Eng., vol. 136, Issue 7 (2014).

*Primary Examiner* — Jesse S Bogue
(74) *Attorney, Agent, or Firm* — Maschoff Brennan

(57) ABSTRACT

The present disclosure provides a solution for a system and a method for converting heat into work. The solution makes use of a nozzle, in which pressurized heat transfer liquid (HTL) and a Liquid-Vapor-Phase-Changing (LVPhC) working fluid is about the same pressure are mixed to form a LVPhC-HTL mixture, which in turn undergoes evaporation and isothermal or quasi-isothermal expansion while flowing in the nozzle that results in acceleration of the mixture. The accelerated mixture is ejected from to thereby rotate a turbine and produce work from the generated kinetic energy.

(Continued)

The LVPhC is separated from the mixture and condensed after its ejection from the nozzle and its pressure is elevated back to the working pressure in the nozzle. The present solution exploits the thermodynamic advantages of each phase of the LVPhC.

20 Claims, 12 Drawing Sheets

Related U.S. Application Data on Jan. 3, 2023, provisional application No. 63/447,131, filed on Feb. 21, 2023, provisional application No. 63/455,712, filed on Mar. 30, 2023.

(56) References Cited

U.S. PATENT DOCUMENTS

| | | | | |
|---|---|---|---|---|
| 4,106,294 | A * | 8/1978 | Czaja | F01K 21/04 60/649 |
| 5,038,567 | A * | 8/1991 | Mortiz | F03G 4/074 60/671 |
| 6,644,062 | B1 | 11/2003 | Hays | |
| 8,061,132 | B2 * | 11/2011 | Fong | F15B 13/00 60/407 |
| 8,196,406 | B2 * | 6/2012 | Oser | F04F 5/54 60/649 |
| 9,644,615 | B2 | 5/2017 | Chaix | |
| 11,002,468 | B2 * | 5/2021 | Pan | F25B 9/08 |
| 12,140,051 | B2 * | 11/2024 | Schlegel | F01K 25/04 |
| 2012/0006022 | A1 * | 1/2012 | Woodland | F01K 25/06 60/645 |
| 2012/0006024 | A1 | 1/2012 | Hays et al. | |

* cited by examiner

HEAT ENGINE USING A LIQUID-VAPOR-PHASE-CHANGING MATERIAL

TECHNOLOGICAL FIELD

The present disclosure is in the field of systems and methods for power generation by heat.

BACKGROUND ART

References considered to be relevant as background to the presently disclosed subject matter are listed below:
WO 2022/049573
WO 2022/234554
U.S. Pat. No. 9,644,615

Acknowledgement of the above references herein is not to be inferred as meaning that these are in any way relevant to the patentability of the presently disclosed subject matter.

GENERAL DESCRIPTION

The present disclosure provides a solution for a system and a method for converting heat into work. The solution makes use of a nozzle, in which pressurized heat transfer liquid (HTL) and a Liquid-Vapor-Phase-Changing (LVPhC) working fluid is about the same pressure are mixed to form a LVPhC-HTL mixture, which in turn undergoes evaporation and isothermal or quasi-isothermal expansion while flowing in the nozzle that results in acceleration of the mixture. The accelerated mixture is ejected from to thereby rotate a turbine and produce work from the generated kinetic energy. The LVPhC is separated from the mixture and condensed after its ejection from the nozzle and its pressure is elevated back to the working pressure in the nozzle. The present solution exploits the thermodynamic advantages of each phase of the LVPhC.

Therefore, a first method aspect of the present disclosure provides a method for converting heat into work. The method comprises: (i) vaporizing or bringing a liquid vapor phase-changing material (LVPhC) from a liquid phase to a vapor phase or a supercritical phase at a temperature of about T1 and a pressure of about P1 and mixing it in a nozzle with a heat transfer liquid (HTL) having a temperature of about T1 and a pressure of about P1. It is to be understood that (i) comprises one of the two: (1) vaporizing the LVPhC at a temperature of about T1 and a pressure of about P1, or (2) bringing the LVPhC to a supercritical phase at a temperature of about T1 and a pressure of about P1. The selection of (1) or (2) depends on the characterization of the LVPhC at the desired working values of T1 and P1. The LVPhC is at a liquid phase below a temperature of about TO in pressure of about P1, wherein TO is lower than T1, thereby mixing the HTL and the LVPhC at T1, and P1 results in evaporation and a quasi-isothermal expansion, as the pressure drops to P0, causing an acceleration of the HTL/LVPhC mixture. The vapor expansion inherently reduces the vapor temperature, but due to the high heat capacity of the HTL and the high heat transfer rate in the mixture, the temperature reduction is minimal. A quasi-isothermal expansion is when the temperature of the vapors along the nozzle maintains at least 95%, 75%, or 65% from the initial temperature when measured in Kelvin; (ii) ejecting the accelerated HTL/LVPhC mixture through a nozzle for converting its kinetic energy into work and collecting the LVPhC and the HTL at a pressure of P0. This can be realized in an impulse turbine or preferably in a reaction turbine. The method further comprises following said collecting: (iii) heating at least a portion of the HTL to a temperature of about T1 and increasing its pressure to a pressure P1 to allow an additional cycle of said mixing. Since the heat loss of the HTL due to the expansion is relatively low, only a portion of the HTL is required to be reheated while the majority of the HTL goes to another cycle. Theoretically, the HTL can go through many cycles until it is required to be reheated. The order of the heating and increasing may be altered, namely the heating can be prior to the increasing or the increasing can be prior to the heating.

A second method aspect of the present disclosure provides a method for converting heat into work. The method comprises: (i) vaporizing or bringing a liquid vapor phase-changing material (LVPhC) from a liquid phase to a vapor phase or a supercritical phase at a temperature of about T1 and a pressure of about P1 and mixing it in a nozzle with a heat transfer liquid (HTL) having a temperature of about T1 and a pressure of about P1. It is to be understood that (i) comprises one of the two: (1) vaporizing the LVPhC at a temperature of about T1 and a pressure of about P1, or (2) bringing the LVPhC to a supercritical phase at a temperature of about T1 and a pressure of about P1. The selection of (1) or (2) depends on the characterization of the LVPhC at the desired working values of T1 and P1. The LVPhC is at a liquid phase below a temperature of about TO in pressure of about P1, wherein TO is lower than T1, thereby the mixture results in evaporation and a quasi-isothermal expansion causing an acceleration of the HTL/LVPhC mixture. A quasi-isothermal expansion is when the temperature of the vapors along the nozzle maintains at least 95%, 75%, or 65% from the initial temperature when measured in Kelvin; (ii) ejecting the accelerated HTL/LVPhC mixture through a nozzle for converting its kinetic energy into work and collecting the LVPhC and the HTL at a pressure of P0. This can be realized in an impulse turbine or preferably in a reaction turbine. The method further comprises following said collecting: (iii) increasing the pressure of the HTL to a pressure P1 to allow an additional cycle of said mixing. The order of the heating and increasing may be altered, namely the heating can be prior to the increasing or the increasing can be prior to the heating.

Theoretically, the HTL can go through many cycles until it is required to be reheated or replaced. The second method aspect is different than the first method aspect by allowing the HTL to operate in an open-loop configuration. For example, the HTL can be sea water and the HTL can be replaced after several cycles just before it reaches a temperature that can no longer operate in the cycle, such as a freezing temperature of the HTL or the phase change temperature at P1 of the LVPhC working fluid. This configuration may be relevant for the implementation of the method when the LVPhC is liquified natural gas-LNG, liquified Hydrogen, or any evaporation process of a liquified LVPhC material.

It is to be noted that any combination of the described embodiments with respect to any aspect of this present disclosure is applicable. In other words, any aspect of the present disclosure can be defined by any combination of the described embodiments. In particular, it is to be noted that any of the below method embodiments can be applied to any of the above method aspects and in any combination thereof.

In some embodiments of the method, said collecting the LVPhC vapor comprises separating the LVPhC/HTL mixture.

In some embodiments, the evaporator is part of the nozzle inside the reaction turbine and the LVPhC is injected into the mixing chamber as droplets.

In some embodiments, an additional pump is connected between the HTL drain and the turbine. Such a pump can change the overall pressure without the turbine changing its frequency (RPM). This is important for generating power at a fixed frequency while the HTL temperature and evaporation pressure vary. For example, if the HTL temperature is reduced below a nominal value, the pump reduces the input pressure of the turbine, and the pressure in the nozzle is reduced. This allows evaporation and production of work at a lower temperature than the nominal temperature. Optionally, increasing the mass flow rate of the LVPhC maintains a fixed void fraction (volume ratio of HTL to vapor) at a lower HTL temperature than the nominal temperature. This allows the nozzle to maintain maximal efficiency at such off-design conditions. In this case, when the nominal HTL's temperature, $T_{nominal}$, changes to another value, T, the change from the nominal mass flow-rate $\dot{m}_{nominal}$ is optionally corresponds to:

$$\dot{m} = \dot{m}_{nominal}\frac{T_{nominal}}{T},$$

when the temperature is in Kelvin. In words: when the temperature is reduced from the nominal value, the mass flow rate should increase at the same portion to maintain the nominal void fraction.

In some embodiments, the system has no pump between the HTL drain and the turbine. In this case, once the temperature is reduced below the nominal value, evaporation stops, and the pressure in the nozzle is reduced. The evaporation returns at the lower pressure and the void fraction changes, reducing the efficiency at off-design operation.

In some embodiments of the method, said liquified LVPhC is liquified natural gas (LNG). Liquified natural gas is a mixture that may include methane, ethane, propane and butane.

In some embodiments of the method, said mixing and said vaporizing are carried out simultaneously. Namely, the LNG is mixed with the HTL in a liquid phase and the HTL heats the liquified LVPhC to vaporize it followed by quasi-isothermal expansion of the vaporized LVPhC.

In some embodiments of the method, said collecting comprises directing the ejected natural gas to natural gas pipe for streaming the natural gas to natural gas consumers. Namely, the pressure P0 of the natural gas after being ejected from the nozzle is the required pressure or above the required pressure for the transportation of the gas in the natural gas pipe to consumers. In some embodiments, when the pressure P0 is below the required pressure for the transportation of the gas in the natural gas pipe to consumers, the method further comprises re-compressing the natural gas to the required pressure for the transportation of the gas in the natural gas pipe to consumers.

In some embodiments of the method, the method further comprises following said collecting: cooling and increasing the pressure of the LVPhC to obtain liquified LVPhC at a pressure of about P1 and a temperature of about T0 to allow an additional cycle of said mixing, namely to go through the step of vaporizing again.

In some embodiments of the method, following said cooling and increasing, the method further comprises heating the LVPhC by a LVPhC heat source from a temperature of about T0 to a temperature between T0 and T1, including T1. Namely, the LVPhC heat source can heat the LVPhC to T1. The LVPhC heat source can be, for example, seawater or any external heat source.

In some embodiments of the method, said cooling comprises passing the vaporized LVPhC, at a temperature about T1 and pressure P0, through a heat exchanger, optionally to exchange heat with the liquified LVPhC having an entrance temperature to the heat exchanger of about TO. This results in an increase of the liquified LVPhC to a temperature of about T1.

In some embodiments of the method, said passing comprises maintaining the majority of the liquified LVPhC in a liquid phase. This occurs at least partially due to the latent heat.

In some embodiments of the method, said cooling and increasing comprises condensing the vaporized LVPhC, or at least the majority thereof, prior to increasing its pressure.

In some embodiments, the method further comprises following said collecting: condensing the liquid and then passing it through a heat exchanger to exchange heat with the collected vaporized LVPhC to obtain heat liquified LVPhC, wherein the method further comprises increasing the pressure of the heated LVPhC to about P1.

In some embodiments of the method, said vaporizing comprises directing a portion of the collected HTL, at temperature below T1 but higher than TO, to exchange heat with the liquified LVPhC. This is carried out independently from said mixing. Namely, though the HTL is operating in a closed-loop, a portion of the HTL that is used for vaporizing the liquified LVPhC is different than the portion of HTL that is used for the expansion in the nozzle.

In some embodiments of the method, said directing is carried out prior to said heating. Namely, the HTL that is directed to be heated initially exchanges heat with the liquified LVPhC prior to receiving heat. This is performed by designing the method such that the end temperature of the HTL after exchanging heat with the liquified LVPhC is at a temperature above the boiling point of the liquified LVPhC at P1.

In some embodiments of the method, said increasing the HTL pressure is carried out prior to said directing, and said heating is carried out following said directing.

In some embodiments of the method, said mixing and said vaporizing are carried out simultaneously. Namely, the LVPhC is mixed with the HTL in a liquid phase and the HTL heats the liquified LVPhC to vaporize it followed by quasi-isothermal expansion of the vaporized LVPhC.

In some embodiments of the method, the HTL is selected from a list consisting of: molten salt, thermal oil, water, salty water, Ethylene glycol, water.

In some embodiments of the method, the HTL is Ethylene glycol.

In some embodiments of the method, the LVPhC material is selected from a list consisting of: water, pentane, isobutane, propane, R134a, R245fa, Fluorocarbons, and toluene, or any vapors used in organic Rankine Cycle (ORC) technology.

In some embodiments of the method, the LVPhC is pentane.

In some embodiments of the method, said ejecting results in the rotation of the nozzle, said rotation of the nozzle causes the generation of the work from the kinetic energy.

In some embodiments of the method, said nozzle is part of, mounted on or attached to the turbine, wherein said turbine is a reaction turbine.

In some embodiments of the method, said nozzle supports a supersonic flow.

In some embodiments of the method, the jet ejected from the nozzle is channeled to form a film flow under centrifugal forces.

In some embodiments of the method, said vaporizing or bringing comprises bringing said LVPhC to a supercritical phase. Namely, at P1 and T1 the LVPhC is at a supercritical phase and after the expansion in the nozzle is in gaseous phase at P0 and about temperature of T1.

Yet another aspect of the present disclosure provides a system for converting heat into work. The system comprises an evaporator for receiving a liquified vapor phase-changing material (LVPhC), namely LVPhC in a liquid phase, and vaporizing it or bringing to a vapor phase or a supercritical phase at a pressure of about P1 and a temperature of about T1. It is to be understood that the evaporator is configured to carry out one of the two: (1) vaporizing the LVPhC to a temperature of about T1 and a pressure of about P1, or (2) bringing the LVPhC to a supercritical phase at a temperature of about T1 and a pressure of about P1. The selection of (1) or (2) typically depends on the characterization of the LVPhC at the desired working values of T1 and P1. The system further comprises a heating volume for heating heat transfer liquid (HTL) to a temperature of about T1. A HTL pump of the system is configured for increasing pressure of said HTL to a pressure of about said P1. The system further comprises a nozzle in fluid communication with the HTL pump and the evaporator and having an inlet portion for receiving said HTL and a mixing portion for (i) allowing mixing said HTL at about said temperature T1 and at about said pressure P1 with said LVPhC at a vapor phase and (ii) allowing said mixture to undergo isothermal expansion to a pressure of about P0 lower than said pressure P1, thereby causing acceleration of said mixture at said nozzle towards an outlet of the nozzle, The system further comprises a turbine configured for rotation in result to the acceleration of said mixture, thereby converting the kinetic energy of the mixture to work. The turbine can be either an impulse turbine or preferably a reaction turbine. The system further comprises a separation unit for separating the ejected HTL and the vaporized LVPhC. The separation unit comprises a collection unit to collect the ejected HTL and to allow directing it to either the heating volume, the HTL pump, the evaporator or any combination thereof, namely to direct it to two or more components. For example, a portion of the HTL may be directed to the evaporator and a portion of the HTL may be directed to the HTL pump.

In some embodiments of the system, said liquified LVPhC is liquified natural gas (LNG). LNG is a mixture including, for example, at least one of methane, ethane, propane and butane. Optionally the LVPhC is hydrogen, water, CO2, or any LVPhC materials.

In some embodiments of the system, said mixing portion is constituting said evaporator. Namely, the LNG is mixed with the HTL in a liquid phase and the HTL heats the liquified LVPhC to vaporize it followed by quasi-isothermal expansion of the vaporized LVPhC in the nozzle.

In some embodiments of the system, the separated vaporized natural gas is directed to a natural gas pipe for streaming the natural gas to natural gas consumers. Namely, the pressure P0 of the natural gas after being ejected from the nozzle is the required pressure or above the required pressure for the transportation of the gas in the natural gas pipe to consumers.

In some embodiments, wherein the LVPhC is LNG, the system further comprises a heat exchanger, in the form of a recuperator, in fluid communication with (1) the separation unit for receiving said ejected vaporized LNG into a heat removal portion of the heat exchanger, (2) a source of LNG at a pressure of about P1 for receiving LNG at about P1 into a heat receiving portion of the heat exchanger, (3) said nozzle for streaming the LNG from the heat receiving portion to the nozzle, and (4) a natural gas pipe for streaming the LNG from the heat removal portion to the natural gas pipe.

In some embodiments, the system further comprises a condenser for receiving said separated vaporized LVPhC and condense it to a liquid state; and a LVPhC pump downstream said condenser for increasing the pressure of the condensed LVPhC (that is received from the condenser.

In some embodiments, the system further comprises a heat exchanger, in the form of a recuperator, in fluid communication with (1) the separation unit for receiving said ejected vaporized LVPhC at a temperature of about T1 and pressure of about P0 into a heat removal portion of the heat exchanger, (2) condenser for streaming the vaporized LVPhC discharged or exits from the heat removal portion thereto, the vaporized LVPhC that is discharged from the heat removal is substantially maintains in a vapor phase, (3) the LVPhC pump for receiving the liquified LVPhC discharged from the LVPhC pump into a heat receiving portion of the heat exchanger, the liquified LVPhC discharged from the LVPhC pump is at a pressure of about P1 and a temperature which may be below TO, and (4) the evaporator for streaming the liquified LVPhC discharged from the heat receiving portion, the liquified LVPhC discharged from the heat receiving portion is at a temperature of about TO and pressure of about P1. The LVPhC is at a liquid phase below a temperature of about TO in pressure of about P1, wherein TO is lower than T1.

In some embodiments, the system further comprises a heat exchanger in fluid communication with (1) the separation unit for receiving said ejected vaporized LVPhC into a heat removal portion of the heat exchanger, (2) condenser for streaming the vaporized LVPhC discharged from the heat removal portion thereto and for receiving the liquified LVPhC therefrom into a heat receiving portion of the heat exchanger, (3) the LVPhC pump for streaming the liquified LVPhC discharged from the heat receiving portion into the LVPhC pump; wherein the evaporator is configured to receive the liquified LVPhC from the LVPhC pump. This defines that the condensed LVPhC can first be heated in the heat exchanger and then pressurized to about P1.

In some embodiments of the system, the liquified LVPhC that is received in the heat receiving portion is discharged from the heat receiving portion such that at least the majority thereof maintain in a liquid phase. This occurs, at least partially, due to the latent heat.

In some embodiments of the system, the condenser comprises the LVPhC pump or a part thereof constitutes the LVPhC pump.

In some embodiments, the system further comprises a LVPhC heat source downstream said condenser to heat the LVPhC to a temperature below or about equal to a vaporization temperature of the LVPhC at pressure of about P1, namely to a temperature between T0 and T1, including T1.

In some embodiments of the system, the evaporator comprises the HTL pump or a part thereof constitutes the HTL pump.

In some embodiments of the system, the evaporator is in fluid communication with said collection unit for receiving at least a portion of the collected ejected HTL to exchange heat with the liquified LVPhC received in the evaporator to thereby vaporize the liquified LVPhC.

In some embodiments of the system, the evaporator is in fluid communication with the heating volume for streaming the HTL following heat exchanging with the liquified LVPhC in the evaporator.

In some embodiments of the system, the HTL pump is downstream the nozzle and upstream the evaporator.

In some embodiments of the system, a portion of the HTL is streamed from the HTL pump to the evaporator and a portion of the HTL is streamed from the HTL to the nozzle.

In some embodiments of the system, at least a part of the mixing portion constitutes said evaporator.

In some embodiments of the system, the HTL is selected from a list consisting of: molten salt, thermal oil, water, salty water, Ethylene glycol.

In some embodiments of the system, the HTL is Ethylene glycol.

In some embodiments of the system, the LVPhC material is selected from a list consisting of: water, pentane, isobutane, propane, R134a, R245fa, Fluorocarbons, and toluene, or any vapors used in organic Rankine Cycle (ORC) technology.

In some embodiments of the system, the LVPhC is pentane.

In some embodiments of the system, said turbine is a reaction turbine and the nozzle is coupled to, mounted on or part of the reaction turbine.

In some embodiments of the system, the collection unit defines a drain for accumulating the separated HTL, and HTL is suctioned from the drain into the nozzle in result to the operation of the reaction turbine, which constitutes the HTL pump. Therefore, suctioning causes the HTL to enter the nozzle at a pressure of about P1.

In some embodiments of the system, the separation unit comprises a curved or circular frame onto which the mixture is ejected, the engagement of the mixture with the curved or circular frame results in a film flow on a surface of the curved or circular frame.

In some embodiments of the system, said evaporator is configured for receiving a liquified vapor phase-changing material (LVPhC) and bringing it to a supercritical phase at a pressure of about P1 and a temperature of about T1. Namely, the LVPhC is a supercritical fluid at a pressure of about P1 and a temperature of about T1.

In some embodiments of the system, the condenser and the LVPhC pump are constituted by a nozzle that comprises: a nozzle inlet for receiving nozzle heat transfer liquid (HTL) stream into the nozzle (the nozzle HTL is different than the HTL of the system), an outlet, a suction compressible fluid inlet and an arrangement of fluid manipulation sections arranged in fluid communication in a cascaded fashion and defining a flow path of said fluid. The arrangement comprises: a second fluid manipulation section having an expanding configuration in the direction of said flow path for receiving the nozzle HTL at a pressure below pressure of suction fluid, wherein the suction fluid is said LVPhC at a pressure about P0, wherein said suction fluid inlet is configured for allowing suction fluid communication between the ambient or the suction fluid source, and said second fluid manipulation section to allow introduction of suction fluid thereinto to be mixed with the nozzle HTL to thereby obtain fluid mixture, said expanding configuration of said second fluid manipulation section is designed for bringing the two-phase mixture to supersonic velocity at least at a distal end thereof; a third fluid manipulation section having a narrowing configuration in the direction of said flow path for decelerating flow of fluid mixture received from said second fluid manipulation section to sonic or subsonic velocity, and for increasing pressure of said two-phase mixture flowing along said third fluid manipulation section; a fourth fluid manipulation section having an expanding configuration in the direction of said flow path and configured for increasing pressure of fluid mixture subsonic flow received from the third fluid manipulation section to a pressure above ambient pressure; wherein said outlet is downstream the fourth fluid manipulation section or is constituted by a distal end thereof and is for discharging the fluid mixture received from the fourth fluid manipulation section, wherein the fluid mixture discharged from the outlet comprises pressurized suction fluid.

In some embodiments of the system, the nozzle further comprises a first fluid manipulation section downstream to the nozzle inlet and upstream the second fluid manipulation section, or that a proximal end thereof constitutes the nozzle inlet and having a narrowing configuration in a direction of said flow path for reducing pressure of the nozzle HTL streamed thereinto below ambient pressure, or below pressure of the suction fluid in the suction fluid source, and for accelerating flow of said nozzle HTL stream.

In some embodiments of the system, the nozzle HTL comprises at least one of water, molten salt, thermal oil, ethylene glycol, molten metal, hydro-carbonate liquids, anti-freezing liquids, liquified gases, or any combination thereof.

In some embodiments of the system, the suction fluid is gas or vapor.

In some embodiments of the system, the fluid mixture is a two-phase mixture and wherein said pressurized suction fluid being discharged from the outlet of the nozzle comprises compressed gas.

In some embodiments of the system, the fluid mixture being discharged from outlet is a liquid mixture and wherein said pressurized suction fluid being discharged from the outlet of the nozzle comprises pressurized liquid.

In some embodiments of the system, the at least one of the fluid manipulation sections has frustoconical longitudinal cross-sectional geometry.

In some embodiments of the system, wherein the nozzle further comprises at least one conduit extending from an exterior thereof into the second fluid manipulation section and configured for channeling the suction fluid into the mixing unit for allowing mixing of the suction fluid with the nozzle HTL flowing therealong, and reducing the speed of sound in the mixture to below the mixture velocity, having a supersonic flow.

In some embodiments of the system, the at least one conduit is connectable to an external suction fluid source.

In some embodiments of the system, the third fluid manipulation section is configured to decelerate the fluid mixture flowing therealong such that it reaches the sonic or subsonic velocity at an extremity of the third sections.

In some embodiments of the system, the discharged fluid mixture comprises a fluid having a discharge pressure value being lower than an initial pressure value of the nozzle HTL streamed into the first fluid manipulation section by up to 1 Bar.

In some embodiments of the system, the initial pressure value is greater from the discharge pressure value by up to 30%.

In some embodiments of the system, the suction fluid streamed into the first fluid manipulation section has a subsonic velocity.

In some embodiments of the system, said nozzle inlet is configured to be in fluid communication with a nozzle HTL source for receiving said nozzle HTL in a pressure greater than ambient pressure.

In some embodiments of the system, the nozzle HTL and the LVPhC are the same liquid or the same material.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION

The following figures are provided to exemplify embodiments and realization of the invention of the present disclosure.

The aim of this present disclosure, compared to any other waste heat recovery (WHR) phase-changing cycle, is to increase the energy density per volume by three orders of magnitude, thereby reducing the size of the heat engine, and inducing isothermal expansion of the working fluid, thereby boosting efficiency. An optional additional advantage is replacing the costly large condenser with an innovative small compressor/condenser. Optionally, the innovative compressor/condenser also compresses the liquefied vapor.

Figure 1:
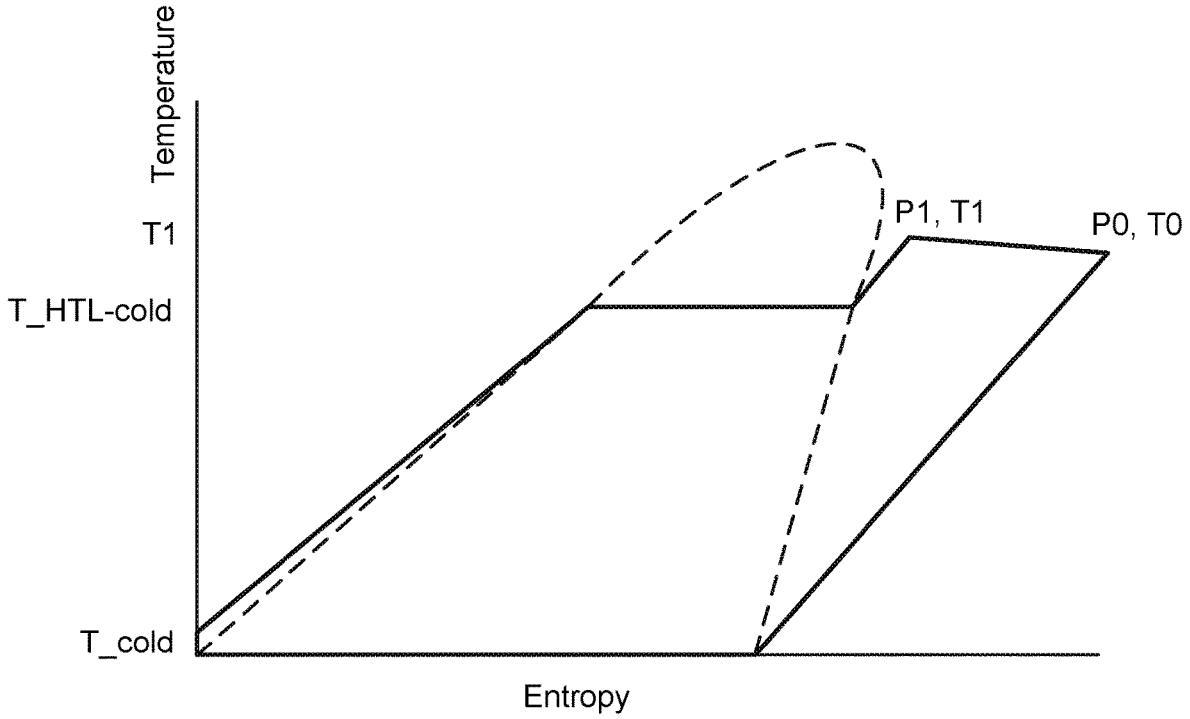
FIG. 1 is an example of T-S diagram of quasi-isothermal two-phase cycle.

A core component in the method and system is a nozzle that mixes compressed gas or vapors with heat transfer liquid (HTL). The HTL maintains liquid in the nozzle. Optionally, the phase-changing material is vaporized from a liquid phase by mixing it with the HTL in the nozzle. Optionally, the vaporization occurs before reaching the nozzle. The vapor mixed with the HTL forms bubbles that expand in the nozzle while keeping nearly the same temperature as the HTL, due to the large heat capacity of the HTL and the excellent heat transfer rate between the vapor bubbles and the HTL. The thermal energy density is defined by the HTL and is orders of magnitude higher than the heat capacity of vapors per volume. The bubbles expansion accelerates the mixture in the nozzle generating thrust at the exit of the nozzle. Both the HTL and the vapors are cooled along with the expansion. This reduction in temperature is less than a few degrees and supports a quasi-isothermal expansion of the mixture. Optionally, the velocity of the mixture in the nozzle becomes supersonic. In the nozzle, the initial pressure and part of the thermal energy of the HTL are converted to kinetic energy under quasi-isothermal conditions. The kinetic energy generates thrust that rotates a turbine, generating electricity, mechanical work, or another form of work. In some embodiments, the turbine is a reaction turbine and the accelerated mixture of the HTL and the phase-changing material is ejected from the nozzle, thereby causing the nozzle to rotate for allowing the conversion of the kinetic energy to work. Reaction turbine has the advantage over impulse turbine due to the non-zero velocity of the jet in the inertial system of coordinates. This non-zero velocity is used to separate the gas/vapor phase from the liquid phase by flowing the mixture on the walls of the turbine creating a film flow. Optionally the walls have a circular shape causing centrifugal force on the film, for separating the gas from the liquid. Reaction turbine as an additional elevating the static pressure nearly to the level of the stagnation pressure in the nozzle, which allows maximal work extraction and maximal efficiency. FIG. 1 shows T-S (temperature vs entropy) diagram for the quasi-isothermal two-phase process. Optionally the LVPhC is superheated.

Figure 2A:
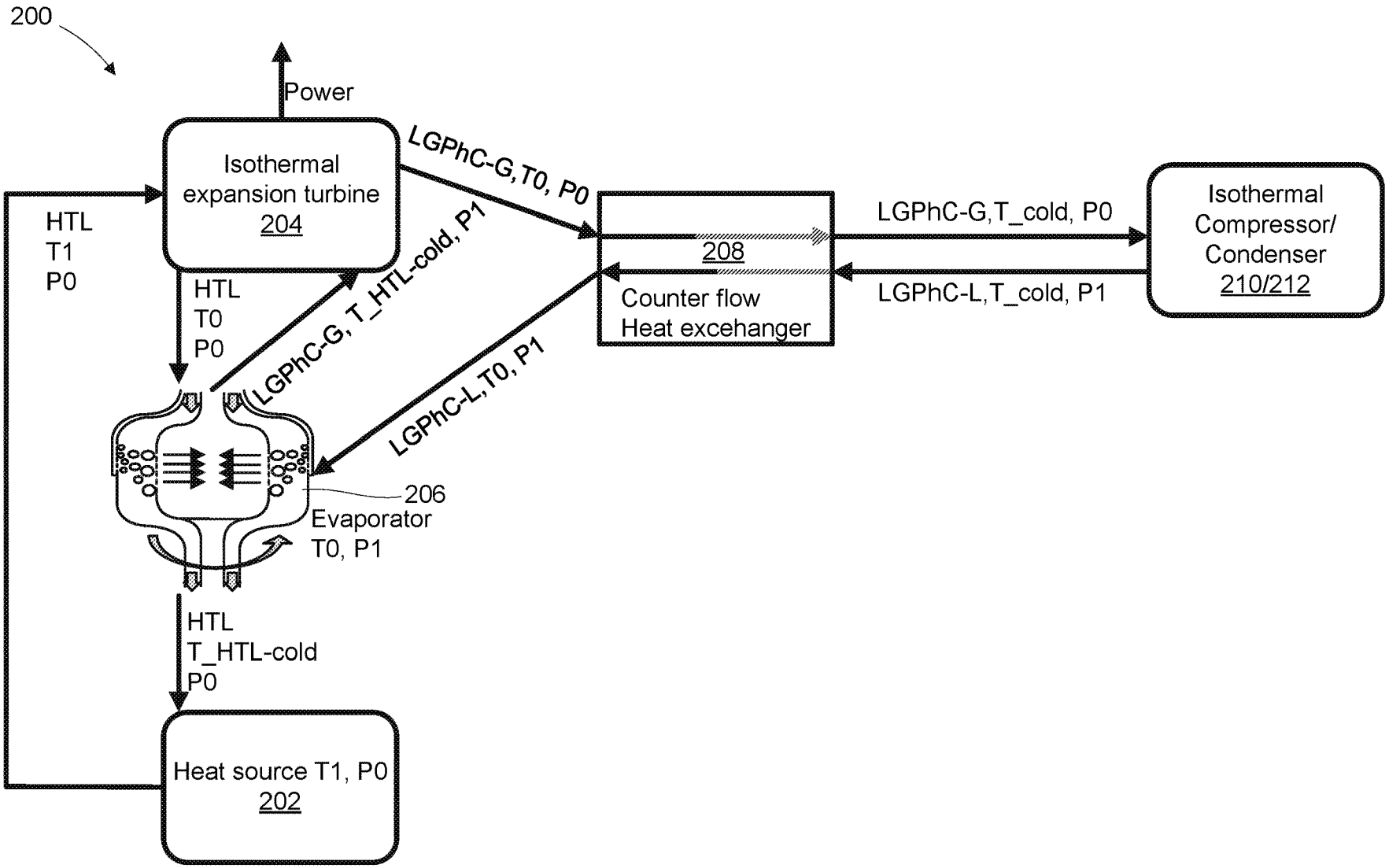
FIGS. 2A-2B are block diagrams of different non-limiting examples of embodiments of the system according to an aspect of the present disclosure.
Figure 2B:
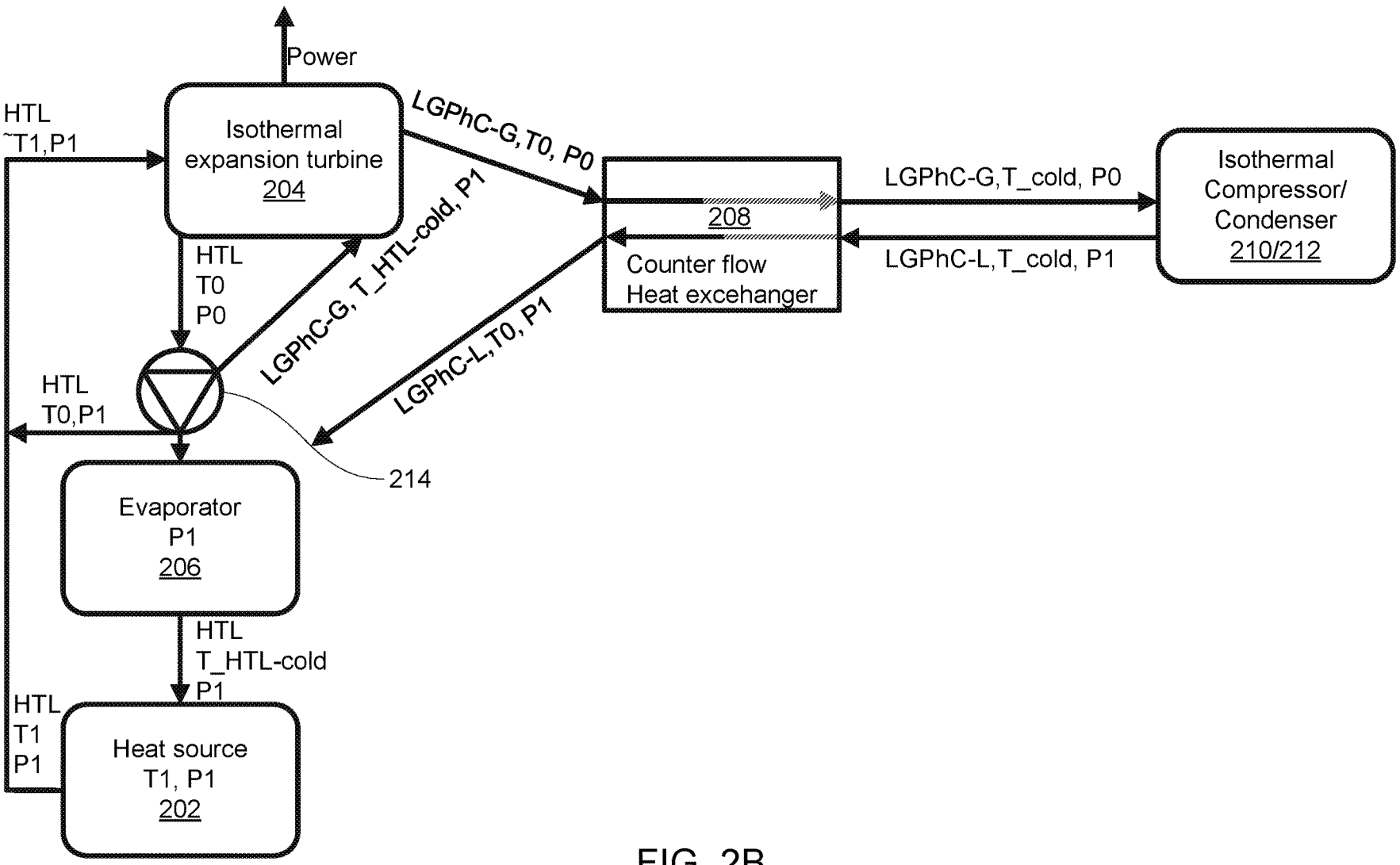

FIGS. 2A-2B are schematic block diagrams illustrations of non-limiting examples of a system according to an aspect of the present disclosure that provide an optional realization of the thermodynamic cycle of FIG. 1.

Reference is first being made to FIG. 2A, which shows a system 200 for converting heat into work. The system 200 comprises a heat source 202 or a heating volume that is configured to heat the HTL to a temperature T1. In this non-limiting example, the HTL is heated to a temperature T1 while it is in a low pressure P0. The hot, low pressure, HTL is introduced into a turbine 204 by centrifugal force, or by a dedicated pump that can be external to the turbine, elevates the pressure to P1. In the turbine 204, the HTL enters the nozzle (not explicitly shown in FIGS. 2A-2B, but it is part of the turbine) at an inlet temperature T1 and pressure P1. At the outlet of the nozzle, the temperature and pressure are P0 and TO, wherein P0 is lower than P1 and TO is lower than T1. We note that for quasi-isothermal expansion TO after one cycle is optionally close to T1, but after many cycles the HTL temperature can be 5%, 10%, 20% or any other value lower than T1 when measured in Kelvin. Also, it is to be noted that P0 can be ambient pressure or any other selected working low pressure. For example, in the case that the system is integrated with a delivery pipe of liquified natural gas (LNG), the low pressure P0 is the pressure that the natural gas in its vapor phase is delivered in the pumps and therefore P0 is above ambient pressure. In some other embodiments, P0 may be also below ambient pressure, for example, 0.7 bar.

A Liquid-Vapor-Phase-Changing (LVPhC) material is the working fluid in the system, which is in a vapor phase at temperature $T_{HTL_}$cold, which is optionally close to the working temperature T1 and pressure P1, and liquid in $T_{cold}$ and P1, wherein $T_{HTL_cold}$ is the temperature of the HTL after exchanging heat with the LVPhC in the evaporator to evaporate the LVPhC and $T_{cold}$ is the temperature of the LVPhC after delivering its heat in a counter flow heat exchanger following the ejection from the nozzle, both are further described below. In some embodiments, $T_{cold}$ is ambient or close to ambient temperature. It is to be noted that the LVPhC may either enter the nozzle as a vapor at pressure P1 or enter the nozzle as liquid and evaporates in the nozzle, wherein in the latter embodiment the evaporator is constituted by a portion of the nozzle. It is to be noted that the term LVPhC is interchangeable with the term LGPhC that is presented in the figures.

The HTL and the LVPhC are mixed in a mixing chamber or a mixing volume in the nozzle to form a two-phase mixture in the nozzle. When the LVPhC is injected to the HTL as a liquid, it evaporates and forms the two-phase mixture. This two-phase mixture is in a temperature T1 and pressure P1 when it is mixed. Then, the nozzle is designed for reducing the static pressure along a flow therein, leading to the expansion of the LVPhC vapors in the nozzle, which in turn leads to the acceleration of the LVPhC/HTL mixture, generating thrust at the nozzle's outlet. This thrust rotates the nozzle, which is a part of a reaction turbine, thereby generating work. The LVPhC/HTL mixture cools along the flow in the nozzle due to the heat supply to the LVPhC along with the expansion, and optionally along with the evaporation, to temperature TO. Practically, such an expansion is quasi-isothermal due to the heat capacity per volume of the HTL which is approximately 1000-fold higher than in gasses or vapors per volume. Quasi-isothermal means that the temperature of the vapors is maintained the same along with the flow in the nozzle within 95%, 75%, or at least 65% when measured in Kelvin. In some embodiments, the flow in the nozzle is supersonic, allowing a higher mass ratio LVPhC/HTL than subsonic flow. The LVPhC is separated by gravity from the HTL after being ejected from the nozzle, and the HTL is collected in the turbine. It is to be noted that the HTL that is collected in the turbine 204 may participate in several cycles of HTL flowing in the nozzle before the HTL temperature is reduced to T_HTL-cold that require its reheating by the heat source 202. Therefore, a significant portion of the HTL that is collected in a drain of the turbine is pumped back to the nozzle at a pressure P1. In some embodiments, where the LVPhC is vaporized before entering the nozzle, a portion or all the HTL in the turbine flows from the turbine housing into the evaporator 206 to transfer heat to the LVPhC and vaporize it.

The LVPhC-vapor after the turbine flows into a counterflow heat exchanger (recuperator) 208 and cools to $T_{_cold}$. Then, the LVPhC flows into a condenser 210 and a pressure increasing unit 212, to condense and increase its pressure to P1. The condenser 210 and the pressure increasing unit 212 can be either two separate units or a single unit that performs both condensation and increasing the pressure. It is to be noted that the condenser 210 and the pressure increasing unit 212 may be arranged along the flow path in any desired sequence, namely the condenser 210 may be upstream the pressure increasing unit 212 or the pressure increasing unit 212 may be upstream the condenser 210. The pressure increasing unit 212 may be either a compressor that compresses the LVPhC in a vapor phase or a pump that increases the pressure of the LVPhC in a liquid phase.

The pressurized LVPhC-liquid in pressure P1 returns to the counterflow heat exchanger (recuperator) 208 for reheating. Optionally, due to the high latent heat, the LVPhC-liquid is partially vaporized in the heat exchanger. Next, the pressurized LVPhC-liquid reaches the evaporator 206 for vaporizing the pressurized LVPhC at high-pressure P1. The temperature in the evaporator 206 drops to $T_{HTL_cold}$ due to the latent heat required for evaporation. Next, the pressurized LVPhC-vapor flows back into the turbine's nozzle for generating work, while the HTL flows from the evaporator 206 to the heat source 202 for increasing its temperature to T1.

Optionally, the evaporator may be in the form of a rotating drum, where the pressure is increased by centrifugal forces when the HTL flows remotely from the axis of rotation of the rotating drum (as detailed below). At high pressure, the LVPhC-liquid is injected, mixed with the HTL, and vaporized. Later the HTL pressure is reduced by flowing next to the axis of rotation.

Optionally, the evaporator is the mixing section that is part of the nozzle. In this case the LVPhC-liquid from the recuperator is directly injected into the nozzle. For maintaining the HTL at T1, a portion of the HTL flows from turbine 204 into the heat source heat exchanger 202 and returns to turbine 204.

Optionally an HTL pump (not shown) is connected between the drain of the HTL to the turbine, for increasing the input pressure to the turbine, and for decoupling the nozzle pressure from the turbine rotational frequency (rounds per minute-RPM). In this case, when the HTL temperature is reduced below the nominal value, the pump reduces the input pressure while the turbine remains at a constant RPM. This reduces the nozzle pressure, allowing for LVPhC evaporation at a lower temperature while generating power at a constant frequency. In addition, the mass flow rate of the LVPhC may vary to compensate for the temperature change. When the nominal HTL's temperature, $T_{nominal}$, changes to another value, T, the change from the LVPhC nominal mass flow-rate $\dot{m}_{nominal}$ is optionally corresponds to:

$$\dot{m} = \dot{m}_{nominal}\frac{T_{nominal}}{T},$$

when the temperature is in Kelvin. In words: when the temperature is reduced from the nominal value, the LVPhC mass flow rate should increase at the same portion to maintain the nominal void fraction.

Reference is now being made to FIG. 2B, which differs from FIG. 2A by including a HTL pump 214 that is configured to elevates the pressure of the HTL from P0 to P1. The HTL pump 214 may be disposed anywhere in the flow path between the collection drain of the turbine, in which the HTL is collected after its ejection from the nozzle, and the inlet of the nozzle. For example, as shown in FIG. 2B, the HTL pump 214 is disposed downstream the turbine, namely right after the collection drain, and the pressurized HTL that exits the HTL pump 214 is either directed to the evaporator 206 or back to the turbine 204, namely a portion is directed to undergo another cycle in the turbine, thus the turbine is designed for small pressure buildup, and a portion is directed to transfer heat to the LVPhC in the evaporator 206 to thereby vaporize it and after is directed to the heat source 202 to be reheated to T1. In this case, the evaporator 206 is simply a mixing tank, in which the HTL and the LVPhC-liquid are mixed, both at P1. Optionally, in the mixing tank the HTL and the LVPhC-liquid flow as the mixture vaporizes while cooling the HTL. At the outlet of the mixing tank, the HTL temperature is reduced to $T_{HTL_cold}$, which is above the evaporation temperature at pressure P1 of the LVPhC. Optionally, an additional pump (not shown) is added after the heat source to compensate for the head loss of the evaporator and the heat exchanger. This guarantees that the two flows of HTL meet at about the same pressure.

The term "about" should be interpreted as a deviation of +20% of the nominal value. For example, if the value is about 10, thus it should be understood to be in the range of 8-12.

Optionally, in each pass in the nozzle, the HTL temperature change is small, less than a degree, or less than a few degrees. In this case, most of the HTL returns to the nozzle, through the by-pass without passing through the evaporator and the re-heating. This way, the HTL temperature is reduced with each iteration. This defines a ratio between the flow rates of the bypass and the evaporator. The advantage is that the number of iterations, N, allows maintaining the LVPhC-vapor expansion at high temperature, leading to high efficiency, while the HTL reaches the heat source at a minimal temperature, which is the liquid-vapor phase-change temperature at P1, extracting maximal heat from the heat source, thereby increasing efficiency.

assuming for a single pass in the nozzle $\Delta T_{expansion}$, at a specific mass ratio. And assuming $\Delta T_{latent}$ for the same mass ratio. Then after N cycles in the turbine, the exit temperature is $T_0=T_1-N*\Delta T_{expansion}$. And at the evaporator the change in temperature is $T_{HTL_cold}=T_0-N*\Delta T_{latent}$. This defines N, which results in the minimal desired HTL temperature, and defines the average operating temperature in the nozzle, thereby defining the efficiency.

For example, Ethylene Glycol is the HTL and pentane is the LVPhC material. For a mass ratio of 0.01 and operating pressure of 14.5 bars, the change in the temperature due to the expansion is about 0.3 degree Celsius and the change in temperature due to the latent heat and mass ratio is about 1.4 degrees Celsius. Also assuming, it is desired to have a high-temperature T1 of 155 C and a low temperature of $T_{HTL_cold}$=100 C. Then, the value of N≅32, defines the number of cycles the HTL pass in the nozzle before flowing to the evaporator. This is also the ratio between the amount of HTL that goes to the evaporator and the recycled HTL in the turbine. The average expansion temperature is 155−N/2*0.3=150 C which is nearly the maximal temperature and the exit temperature from the evaporator is 155−44 (0.3+1.4)≅100 C which is the minimum desired temperature for evaporating pentane at P1.

Optionally the LVPhC/HTL mass ratio is between 10% to 0.1% (a small portion of LVPhC in HTL).

Figure 3:
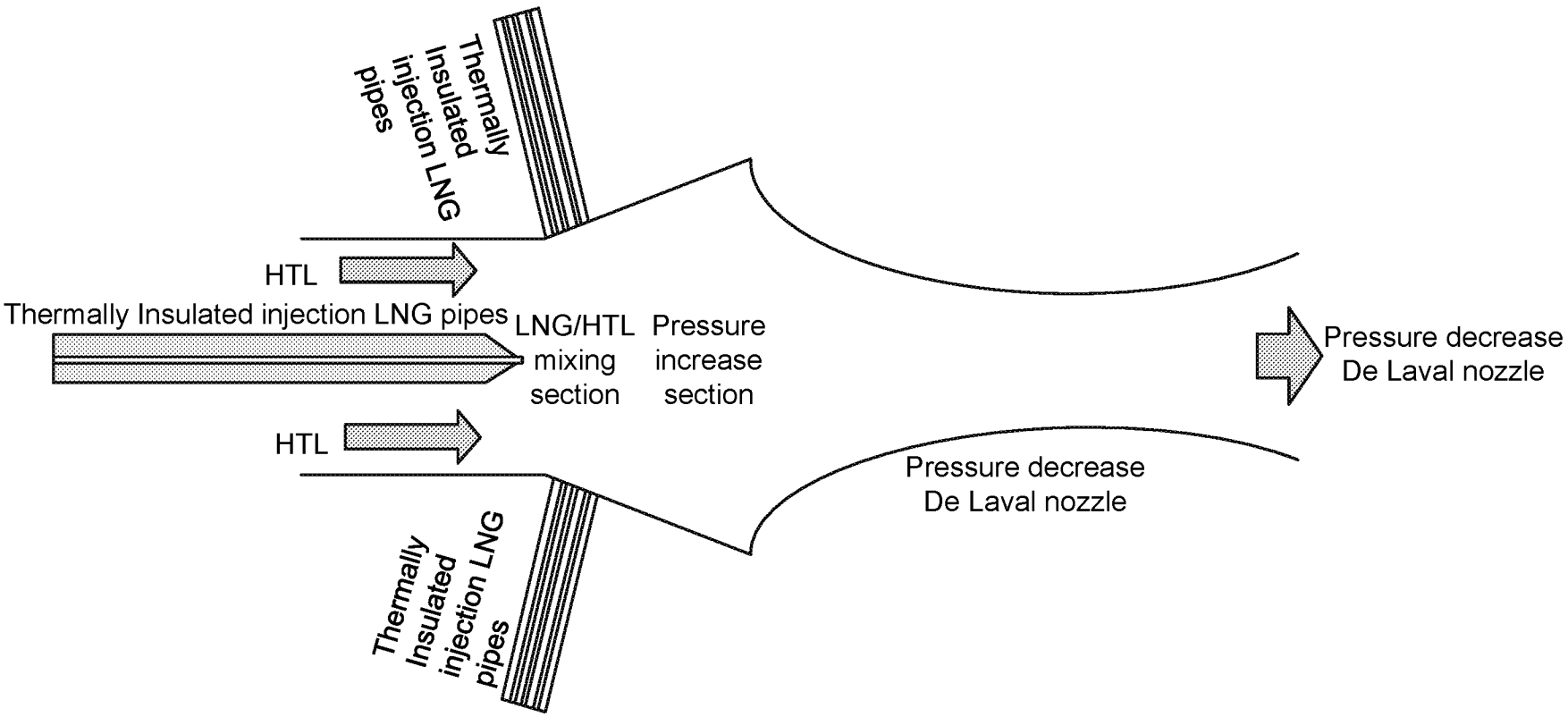
FIG. 3 is a schematic illustration exemplifying injection of LVPhC into the nozzle.

Optionally, the LVPhC enters as a liquid into the nozzle, and evaporation occurs in the nozzle. This requires thermally insulated liquid-LVPhC pipes to reach the mixing chamber, which may be in the case of using natural gas as the LVPhC. FIG. 3 shows an optional nozzle where the liquid-LVPhC flows in insulating pipes and is injected into the mixing chamber as a liquid. It is to be noted that while FIG. 3 exemplifies the injection of LNG, this can be realized by any suitable LVPhC.

Optionally, the speed of sound in the mixture drops due to the bubbly media, and the velocity of the LVPhC/HTL mixture becomes supersonic. In such an option, De-laval two-phase nozzle design is applied (See reference for supersonic two-phase flow in "Thrust Enhancement Through Bubble Injection into an Expanding-Contracting Nozzle With a Throat Sowmitra Singh", Tiffany Fourmeau, Jin-Keun Choi, Georges and L. Chahine, DOI: 10.1115/1.4026855).

Optionally, when reaching the nozzle, the vapor-LVPhC is heated to T1. Optionally, this heating is isochoric (constant volume). This is achieved when the HTL velocity is sufficiently high to carry the LVPhC to a section area where the pressure increases while heating the LVPhC. Optionally, for subsonic flow, this occurs in a broadening cross-section. Optionally the heating is at constant pressure (isobaric) or any combination between isochoric and isobaric. For isobaric heating, the mixing chamber is optionally having a broadening cross-section for compensating the additional volume. Optionally, the broadening cross-section of the mixing chamber is dimensioned to be suitable for the additional volume change of the LVPhC vapor additional volume. After heating, the LVPhC vapors expand isothermally, or quasi-isothermally accompanied by heat transfer from the HTL to the LVPhC vapors. Optionally the vapor temperature when exiting the nozzle is similar to the HTL temperature. Optionally, the LVPhC temperature is lower than the HTL temperature by 1%, 10%, or 20% when measured in Kelvin.

The method is optionally described by the engine cycle stages:

1→2: Liquefied LVPhC is pumped from the condenser and pressured to a pressure P1 similar or close to the pressure in the mixing chamber in the nozzle.

2→3 The liquefied LVPhC exchange heat with the vapors going out of the turbine, increasing its temperature with no phase change (Due to the high latent heat, the liquified LVPhC stays liquid). Optionally, part of the LVPhC vaporizes.

Optionally stages 1→2 and 2→3 are exchanged and the LVPhC-liquid is first heated in the Recuperator and then its pressure is elevated to P1.

3→4: The compressed liquid (optionally partially vapor) LVPhC is injected into the evaporator, where it is vaporized. Optionally this stage is done in the nozzle.

4→5: The compressed vapor-LVPhC mixes with the HTL in the mixing chamber in the nozzle, where HTL flows. The static pressure and temperature reduction along the flow in the nozzle result in quasi-isothermal expansion, accelerating the LVPhC/HTL mixture and generating thrust at the nozzle's outlet, which rotates the turbine, generating electricity, mechanical work, or another form of work. Optionally, the velocity of the mixture is supersonic in part of the nozzle.

5→6: The high-temperature vapor-LVPhC vapors exit the nozzle, separated from the HTL, and flow to the heat exchanger (recuperator) where they exchange heat with the liquid-LVPhC going out of the condenser, with no phase change (the vapor stays vapor). Optionally, part of the vapors condenses.

6→1: The vapors are cooled until condensation in a condenser and compressed as a liquid.

Figure 4:
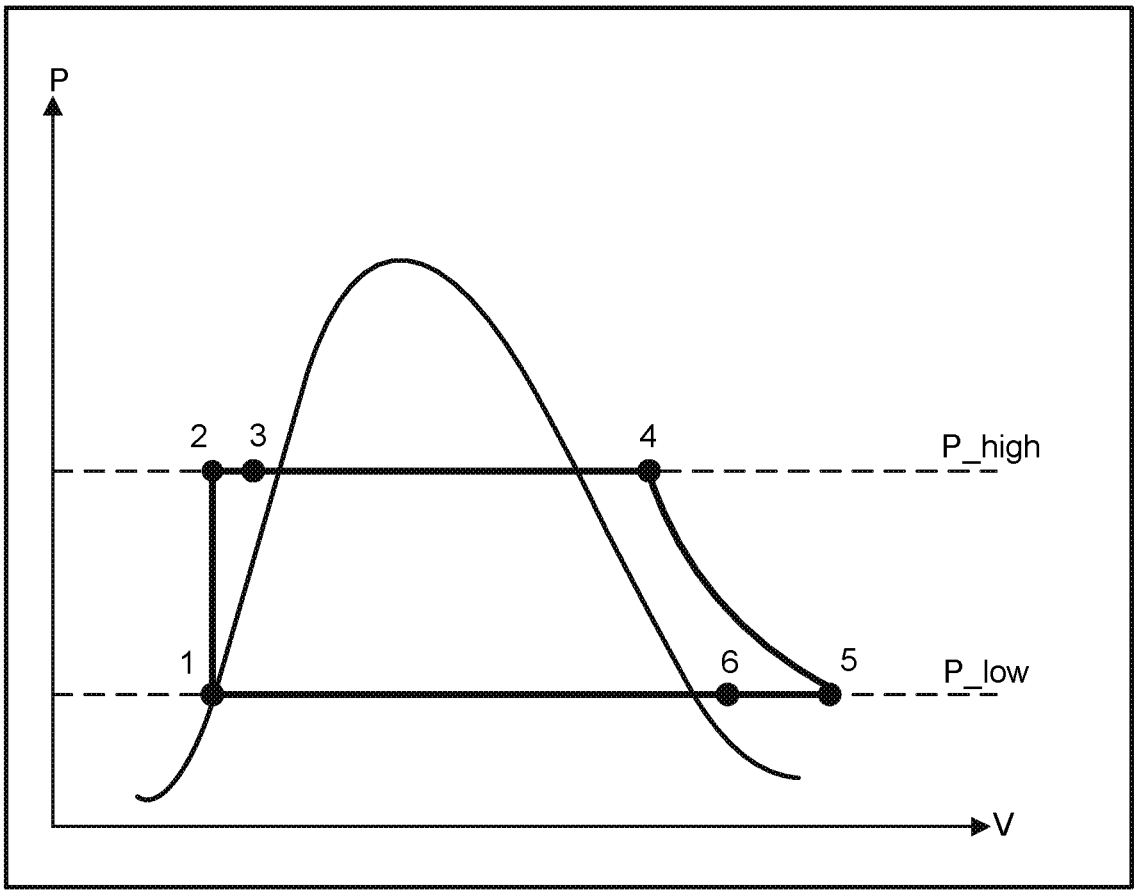
FIG. 4 is an example of the P-V diagram for the thermodynamic cycle.

FIG. 4 shows the P-V diagram for the thermodynamic cycle.

This method is optionally realized for converting low temperatures to work using organic LVPhC as in organic Rankine cycle (ORC), but with isothermal expansion, which is more efficient then adiabatic expansion. Examples of LVPhC materials are anti-freezing materials such as ORC conventional materials: pentane, isobutane, propane, R134a, R245fa, Fluorocarbons, and toluene.

Figure 5:
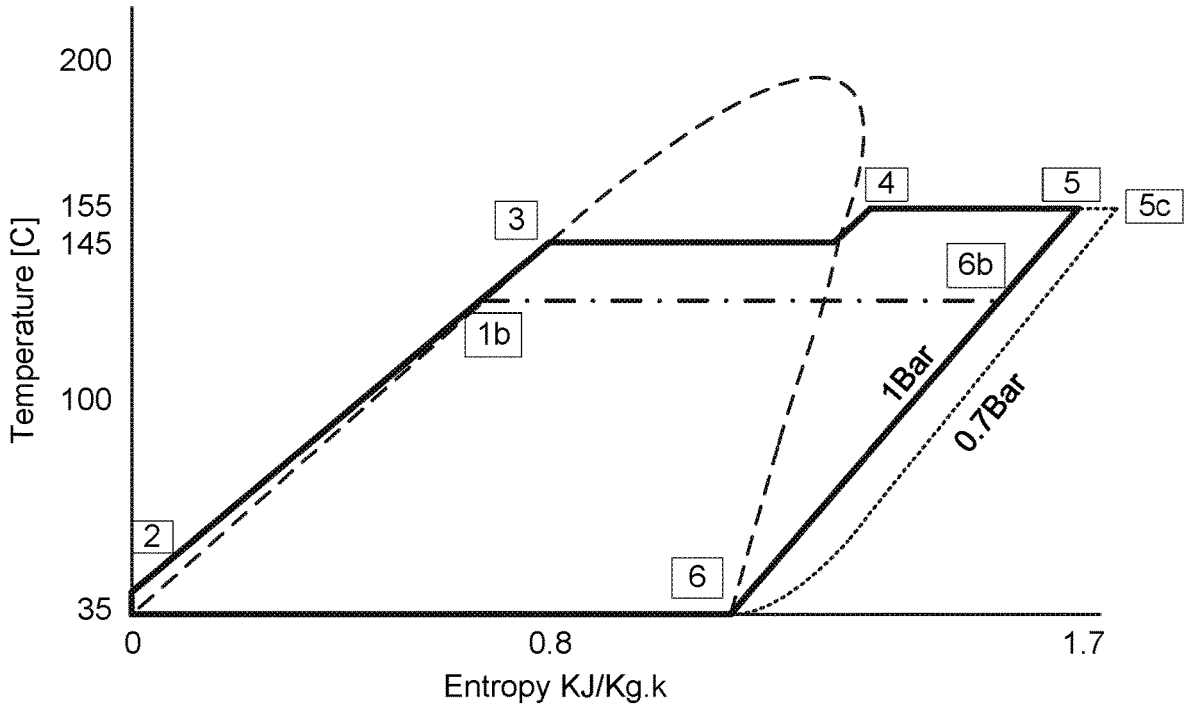
FIG. 5 is an example of a controlled volume calculation for the thermodynamic cycle when using the two-phase pentane and Ethylene Glycol as HTL.

FIG. 5 and the list below, depicts an example of a controlled volume calculation for the thermodynamic cycle when using the two-phase pentane and Ethylene Glycol as HTL.

Considering 1 Kg of Pentane where the numbers in the T-S diagram are the different thermodynamic states for $P_0$=1 Bar, $P_1$=14.5 Bar, $T_1$=155 C, $T_{HTL_cold}$=35 C:

6→1: Condensation: 342 KJ/Kg.

1→2: LVPhC-Liquid pumped isentropic compression to $P_1$: 4 KJ/Kg.

2→3a: LVPhC-Liquid exchanges heat with LVPhC-vapor assuming 30 deg gap: 146 KJ/Kg.

3a→3: Additional heat from HTL to reach liquid-vapor equilibrium point at $P_1$: 144 KJ/Kg.

3→4: LVPhC-Liquid vaporization and heating vapor to 155 C: 246 KJ/Kg.

4→5: LVPhC-vapor expands in the nozzle-isothermal Work: 133 KJ/Kg.

5→6: Cooling of the vapors in heat exchange: 146 KJ/Kg.

This calculation shows a cycle efficiency of $$\eta = \frac{133 - 4}{133 + 246 + 144} = 0.24.$$

When assuming an ideal heat exchanger (OC temperature difference), the efficiency reaches the Carnot efficiency, which is doubled compared to the conventional ORC efficiency under similar conditions.

Optionally, the condenser operates above the expansion final pressure P0. This requires that the condenser compresses the vapor before or along with the condensation. This allows for maintaining a higher condensing temperature, which reduces the cooling (5-6 in the figure) and heating (3-4 in the figure) stages, which optionally eliminates the need for a heat exchanger before and after the condenser. Therefore, the temperature of stages 6 and 1, is optional, elevated (dotted-dashed line and points 1*b* and 6*b* in the figure) above ambient temperature. Optionally the condensation is at a temperature higher than 50° C., 75° C., or 100° C. For example, Pentane at 120° C. has a vapor pressure of 9 Bar. Optionally, operating the turbine at 120° C. and 9 Bar, by injecting pentane at 9 bar into the nozzle where the pressure drops to 1 Bar. Next, cooling the vapors to 100° C., compressing and condensing the vapors at 100° C. and 9 bars, where the liquid pentane is re-injected into the nozzle. The high-temperature condensation reduces condenser size and cost. The high condensation pressure also allows operation when the ambient temperature elevates. Optionally, increasing the condensation pressure when the ambient temperature elevates, for continuous operation under any environmental conditions. The high-temperature condensation removes the need for the heat exchanger between the turbine and the condenser, saving costs. However, the cycle efficiency is defined by the high temperature, T1, and low temperature, T_cold, which requires T_cold to be as low as possible.

Another option is to eliminate the heat exchanger recuperator between the turbine and the condenser. In this case, the hot vapors are cooled when mixed with the HTL in the condenser (see details below), and this heat is removed by an air blower or other methods, maintaining the condenser temperature T_cold as low as possible. Heating the pressurized liquid-LVPhC after the condenser, is optionally achieved by the heat source, reducing its temperature to T_low. The elimination of the (gas/liquid) heat exchanger recuperator and replacing it with a liquid/liquid heat exchanger between the heat source and the liquid-LVPhC reduces the costs significantly.

Figure 6:
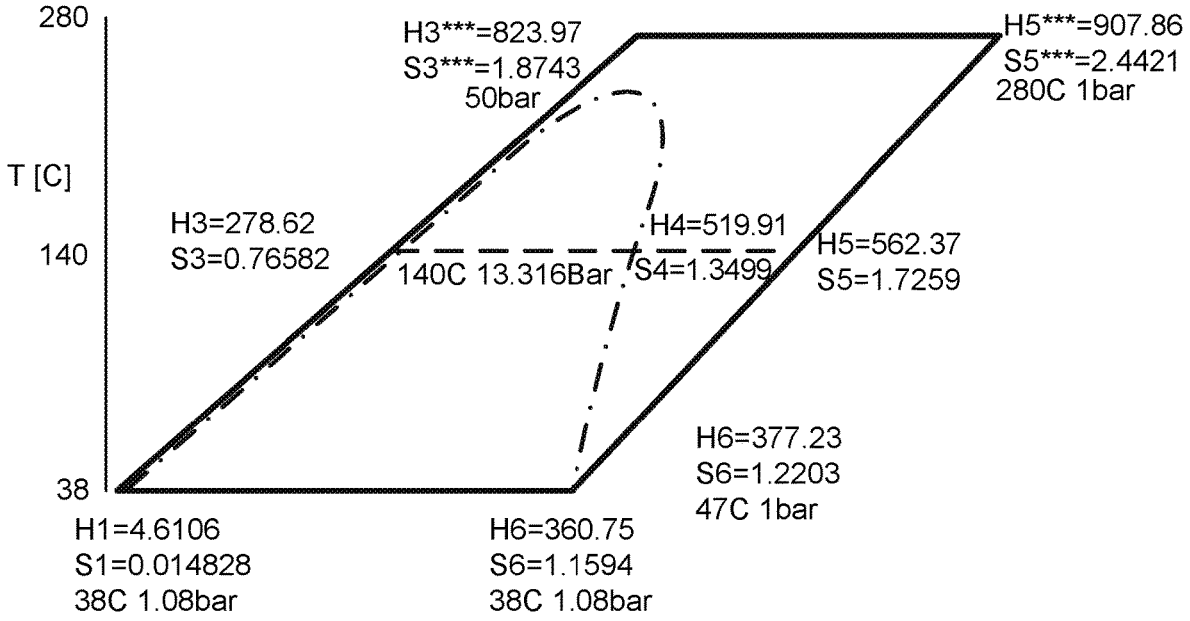
FIG. 6 shows an example of a thermodynamic cycle employing supercritical conditions.

In another example, supercritical conditions are used for energy conversion. FIG. 6 shows such a thermodynamic cycle using pentane. The black-closed solid line cycle is the supercritical cycle. Pentane, a non-limiting example of LVPhC, is heated above the phase transition curve, for example to 280 C at 50 Bar pressure. At this supercritical temperature and pressure, the pentane is in a mixed liquid-gas state. Along with the expansion, the pressure is reduced, and the gas phase is dominant (black upper horizontal solid line at 280 C, in FIG. 6). Since the nozzle contains bubbly media, the mixed state doesn't affect the operation, or cause damage as may occur in gas turbines. The advantage is the amount of work extracted. As can be seen in a conventional cycle (dashed horizontal line at 140 C in FIG. 6), along with the heating, much of the enthalpy is invested in phase change without generating work. The total work that can be extracted (H5-H4 in FIG. 6) is about 43 KJ/kg. On the other hand, at the super critical isothermal expansion, the available work (H5*-H3* in FIG. 6) is about 84 KJ/Kg, which is nearly double the conventional cycle. Working in supercritical conditions is limited by material durability or the engineering limit on the operating pressure and temperature.

Another example is waste heat recovery from steam. Assume steam at 135° C. and 2.4 Bar. The following cycle, or similar, may be considered. The steam is injected into a water reservoir at a pressure of 2.3 bars. The water is heated to just below the evaporation temperature (~130° C.). The heat exchanger between the water and Ethylene glycol raises the temperature of the Ethylene glycol to 120° C., where it flows into the nozzle of a turbine cooperating at 9 Bar. Pentane liquid at 9 Bar is injected into the nozzle, evaporates, accelerates the HTL/Pentane mixture, and generates thrust and electricity. In some embodiments, the nozzle is a part of a reaction turbine and it rotates as a result of the ejected HTL/pentane mixture from it. In some embodiments, the non-zero velocity jet emerging from the nozzle creates a film flow on the walls of the reaction turbine. Such a film flow has optionally centrifugal forces that separate the vapor phase from the liquid phase. The pentane vapors are cooled in a heat exchanger, condensed and pressurized as a liquid, return to the heat exchanger, heated, and return to the nozzle. Optionally, the condensation is at a higher temperature than the ambient. Optionally, the heat exchanger is eliminated, and the condenser is cooled to 50° C. Optionally heating the liquid pressurized pentane from 50° C. to 135° C. is done by the residual heat at the heat source reducing its temperature from 120° C. to 50° C.

Figure 7:
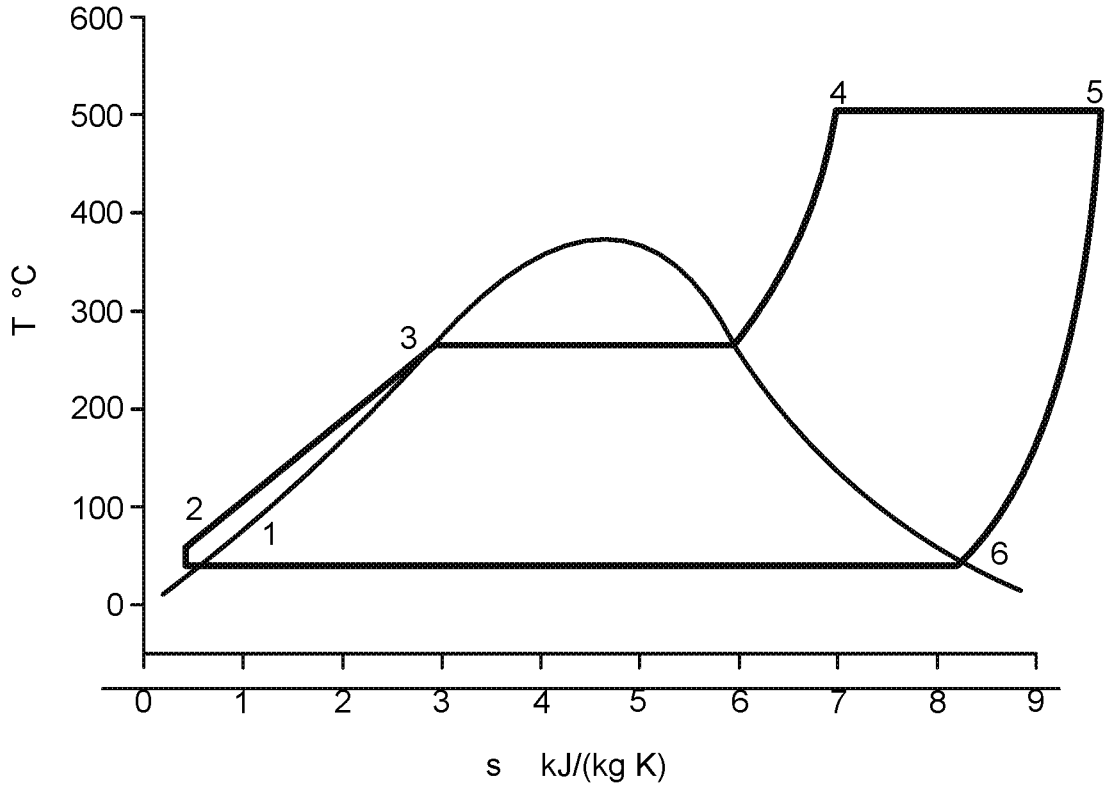
FIG. 7 shows an example of a thermodynamic cycle of the present disclosure when employing waste heat recovery from steam.

The same proposed thermodynamic cycle can be implemented at higher temperatures, as in the Ranking cycle, but the quasi-isothermal expansion in the nozzle supports double efficiency. For example, using water as LVPhC and thermal oil or molten salt as HTL. Where the water evaporates when mixed with the molten salt. For this, the molten salt needs to be chosen so it will not chemically react with the water vapors in a way that damages the operation (creating toxicity, corrosion, erosion, etc). Here are some examples of typical parameters $T_1$=530 C, $P_1$=50 Bar, $P_0$=0.06 Bar, $T_0$=40 C (see FIG. 7).

The advantage of the method is at least the following: (1) the HTL has a higher thermal density by three orders of magnitude than any gas or vapor, thus it allows for reducing device size; (2) inducing quasi-isothermal expansion, which is nearly as efficient as the Carnot Ericsson, and Stirling cycles, is much higher than the efficiency in the conventional adiabatic expansion (as in ORC). This is achieved by mixing bubbles of vapors in the HTL.

Conventionally, in ORC a huge and costly condenser is used, and then a pump for increasing the pressure of the organic liquid. For achieving the same in a much smaller and cheaper way, we describe the following condenser/compressor. Optionally, the organic vapors and the HTL in the condenser/compressor are nearly at the same pressure. In this case, the vapors are bubbled into a heat transfer liquid (HTL) in a chamber, at a temperature below the phase transition, where the vapors liquefy due to the large surface area of the vapor bubbles and high heat capacity of the HTL. Optionally, the HTL is heavier than the liquid-LVPhC, and a counterflow is designed by injecting the vapors from the bottom and collecting the liquid-LVPhC at the top. The HTL inlet is at the top and the outlet is at the bottom.

Optionally, HTL is water, other organic liquid such as Ethylene glycol, the same organic material as the organic vapors in a liquid phase, or any other liquid having a liquid phase in the operating temperature. Optionally, the HTL inlet temperature is between-200° C. and 140° C. The low-temperature HTL is optionally used to liquefy air, Nitrogen, Hydrogen, CO2, or any other gases.

Figure 8:
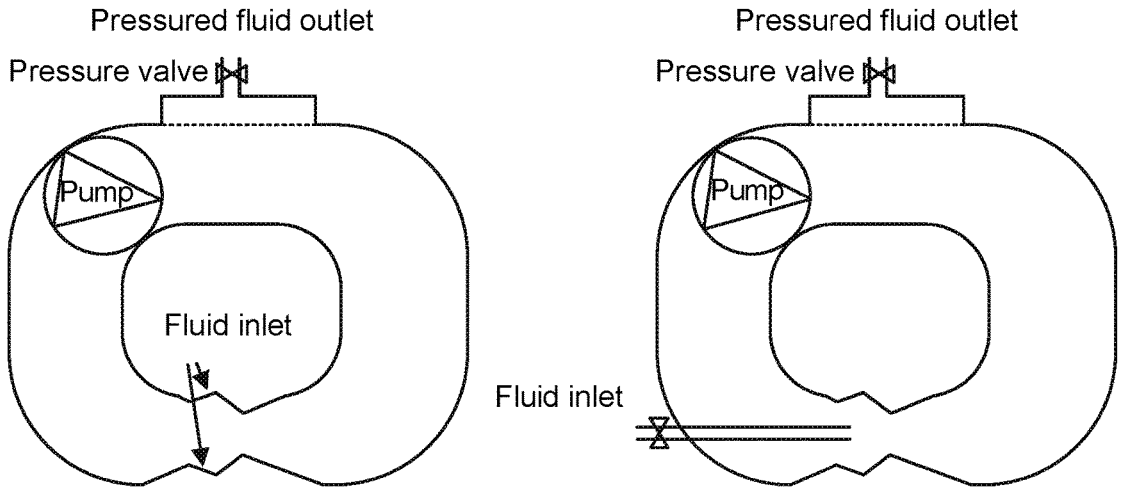
FIG. 8 is a schematic illustration of a condenser and compressor to be used in the system of the present disclosure.

An optional method and system for condensing and compressing gases or vapors are described in FIG. 8. The system is designed to increase the surface area between the condensing liquid and the condensed vapors, thereby reducing the size and costs of the compressor. A closed loop flow of HTL is driven by a pump, at a pressure above ambient. A nozzle is designed to reduce the pressure below the incoming vapor pressure. This allows the vapors, or other gas, to be sucked into the HTL flow. The gas can enter from the peripheral envelope or through a designated pipe. The vapors and the HTL are mixed and the vapors liquified due to the temperature of the HTL and its high heat capacity compared to the vapors per volume. The shape of the nozzle is designed to increase the pressure at the outlet of the nozzle above ambient pressure. Optionally all the vapors are liquified at the mixing section with the liquid, and the nozzle expands for retrieving high pressure. In such a case the nozzle is diverging (pressure reduced below ambient pressure), followed by a mixing chamber, which optionally is diverging and allows vapors to flow into the liquid, followed by a diverging outlet for increasing the pressure of the liquid. Optionally, the mixing section length is sufficiently long to allow >10%, >30% or >90% of the vapors to liquefy. Optionally, part of the organic material is left in the vapors phase and compressed as gas. Optionally, the vapor/HTL mixture reduces the speed of sound below the flow velocity of the mixture, leading to a supersonic flow in the nozzle. In this case, a reversed De-Laval nozzle is designed. Optionally, the compression is isothermal, or quasi-isothermal. Optionally, in case the HTL is of a different liquid than the organic material, after the nozzle, the mixture is separated by gravity, or by centrifugal action, or any other separation method. The organic liquid is collected (in the upper part in case its density is lower than that of the HTL), while the HTL reaches the pump and continues circulating. The HTL is heated along with condensation and compression. The hot HTL is replaced with a cooled HTL for the continuous operation of the compressor (not shown in the figure). Optionally, cooling the HTL without replacing it, is done by heat transfer to the surroundings through the surface of the flow. Optionally, the compressor pressure at the suction is below ambient pressure. For example, 0.7 Bar. This allows the turbine to operate between the maximally compressed pressure and the minimal inlet pressure, 0.7 Bar in this example. Due to the large surface area, leading to fast condensation, the additional pressure gap is achieved by compressing fluid, which is energy efficient. In FIG. 5, point 5C describes the additional power production by the turbine, due to the reduced end-pressure, and the dotted line describes the condensation and compression reaching point 6. At steady-state conditions, the HTL may evaporate under sub-ambient pressure at the low-pressure region. In this case, the flow duration in the low-pressure region is much shorter than the heat exchange rate. Therefore, the HTL doesn't have sufficient time to absorb the heat of evaporation from the environment and is maintained as a liquid, which allows the HTL and the LVPhC to be the same material. For example, condensing vapors of Pentane with liquid Pentane as HTL working fluid that flows in the condenser/compressor. At the low-pressure region, the conditions may support the vapor phase but as long as the flow in the low-pressure region is faster than the speed of sound, there is no phase change. Also if the HTL temperature is lower than the evaporation point, as long as the flow in the low-pressure region is faster than the heat transfer rate, there is no phase change. Instead the liquid sucks the vapors of pentane arriving from the turbine condensing it and compressing it. The advantage is the elimination of the separation between the two liquids after condensation.

The ability to operate at a lower pressure than ambient allows conversion at low temperatures. For example, at 100 C the phase change of pentane is about 7 Bars, which at the turbine generates a small amount of work when the expansion drops the pressure to 1 Bar ambient pressure. The ability to operate the turbine from 7 Bar to 0.46 Bars effectively generates work as if the operating pressure is between 15 Bars and to 1 Bar, typical to 155 C. Optionally, the condenser/compressor inlet pressure of vapors is designed to be less than 1 Bar, less than 0.5 Bars, and even less than 0.1 Bar. The ability to condense and compress the vapor at a faster rate than the heat transfer rate allows for completing the process at a higher temperature. For example, fast compression to 10 bar allows condensation also at a temperature of 90 C or higher. That is, in FIG. 5 the condensation optionally ends in point 3 or between points 2 and 3. The increase in the temperature difference between the compressor and the ambient increases the cooling rate and reduces the compressor size accordingly. Optionally, the HTL in the compressor is maintained at a temperature that is more than 30 C, 50 C, 70 C, or 90 C above ambient. Optionally, the high-pressure condenser operates at the turbine outlet temperature TO, removing the need for a (costly) heat exchanger between the turbine and the condenser. Even though the cycle efficiency is reduced by elevating the T_cold, the cost $/kW of the engine may be reduced. For high efficiency, it is preferred to reduce the HTL temperature and allow the cooling of the vapors in the mixing chamber before increasing the pressure. Optionally, before increasing the pressure, the vapor temperature reaches the HTL temperature within 5%, 10%, or 20% when measured in Kelvin.

Figure 9:
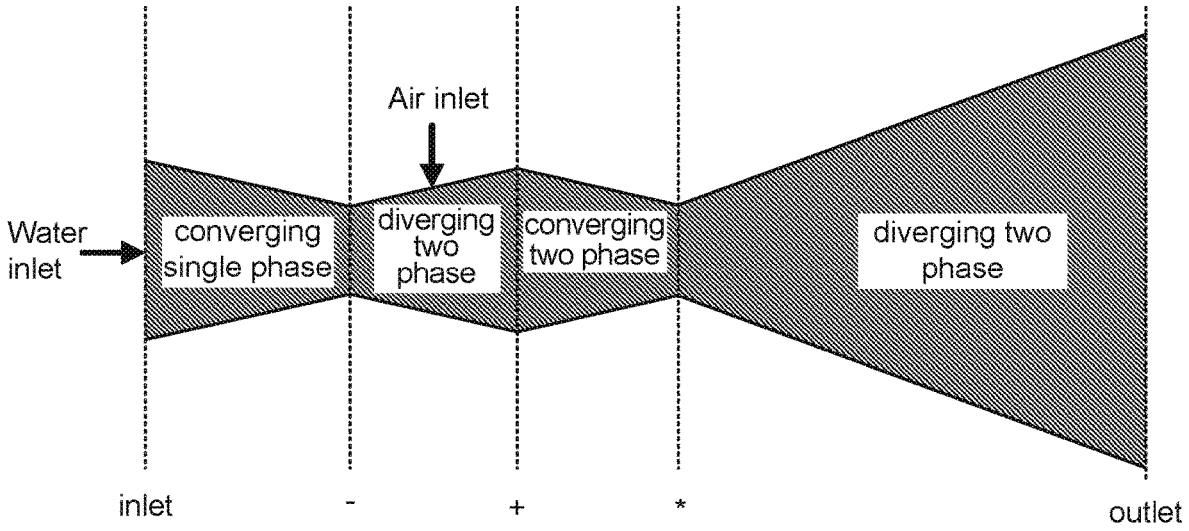
FIG. 9 is a schematic illustration of a cross section of a nozzle for condensing and compressing fluid to be optionally used in the system or method of the present disclosure.

FIG. 9 shows an example of a reversed De-Laval nozzle for supersonic continuous isothermal compression of gas or vapors (not to scale). The nozzle may include the following sections in order:

1. Converging Inlet section for reducing pressure beyond ambient pressure, composed of HTL only.
2. Diverging two-phase flow section, where the pressure stays constant while vapor is sucked into the HTL from the ambient through holes or voids in the nozzles envelop. The section marked "–" is where the suction begins, and the section marked "+" the suction ends. Optionally, this section is sufficiently long to allow the temperature of the vapors to reach the HTL temperature as much as possible. The mixture reduces the velocity of sound below the velocity of the mixture. At the end of the "Diverging two-phase flow section" (marked with a "+") the flow is supersonic.

3. Converging two-phase section, where the pressure increases and the Mach number (ratio between the flow and sound velocities) is reduced. At the end of this section, marked with "*", Mach=1. Optionally March-1 is reached earlier in the converging two-phase section.
4. Diverging two-phase outlet, where the pressure increases and the Mach number reduces.

An efficient method for evaporating the LVPhC is using the HTL after exiting the turbine at a lower temperature, TO, Optionally after a few cycles flowing in the nozzle. This way the expansion is at the high-temperature HTL for maximal efficiency. The remaining lower-temperature thermal energy of the HTL is used to evaporate the liquid LVPhC at high pressure.

Optionally, if the HTL and the liquid LVPhC are at similar pressure, a chamber is used to mix the HTL and the liquid LVPhC, evaporation occurs, and the vapors are collected at the top of the chamber. Optionally, a direct contact counterflow heat exchanger configuration is done by injecting the HTL at the top of the chamber and the outlet at the bottom, while the liquid LVPhC is injected at the bottom of the chamber.

Figure 10:
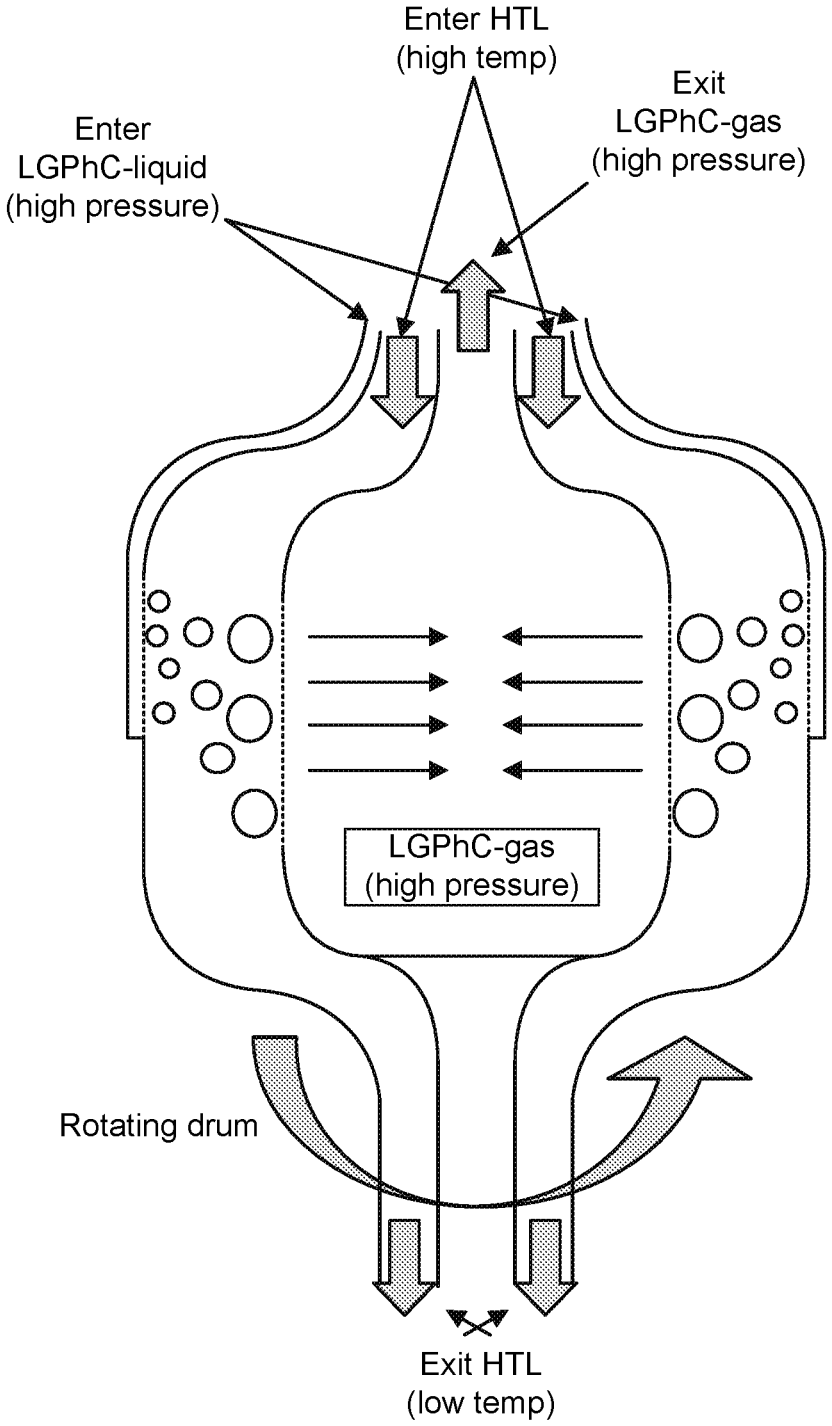
FIG. 10 is a schematic illustration of an evaporator to be optionally used in the system of the present disclosure.

For mixing a low-pressure HTL (exiting the turbine) with the high-temperature liquid LVPhC the following direct contact evaporator is optionally used, as also mentioned above. It is composed of a rotating drum having a high-temperature HTL entrance channel and a low-temperature exit HTL channel, both near the rotating shaft to reduce centrifugal pressure. The HTL flows at the boundary of the drum, where the centrifugal pressure is close to the pressure of the liquid LVPhC. The liquid LVPhC is injected into the HTL at the high-pressure region and evaporates by cooling the HTL. The vapors reach the center of the drum by centrifugal force and exit at high pressure through the vapor-LVPhC exit channel. The cold HTL exits the drum near the shaft. Such a device operates continuously, with very low mechanical work invested. This is because the HTL enters and exits at close to ambient pressure as happens close to the shaft. FIG. 10 shows an example of such an evaporator, having the rotating drum, the entrance, and exit of HTL next to the rotating shaft at low pressure, and the injection of liquid-LVPhC into the HTL at the high-centrifugal-pressure region where it mixes with the HTL and evaporates while cooling the HTL. The vapors flow to the center of the drum and exit at high pressure.

As also mentioned above, the solution provided in the present disclosure may exploit the re-gasification process of LNG.

Prior art for harvesting the energy extracted in the re-gasification process includes direct expansion techniques such as the open Organic Rankine Cycle (ORC) where the natural gas is used as the organic working fluid. In that concept, the LNG is compressed (as a liquid) to the required supply pipe pressure. After heating with seawater, the gasification elevates the pressure, which is converted to work using an organic turbine. The gas expands adiabatically, and the temperature drops with expansion which requires a second heat exchanger (also using seawater) for achieving room temperature. Conventional pipe pressure is in the range of 70 Bar-150 Bar. Conventional expansion isentropic (adiabatic) efficiency is 80%, and the two heat exchangers are a major loss of energy. Another method is using the LNG as a cold source for the ocean thermal energy conversion (OTEC) Ranking cycle. This Ranking cycle can extract energy due to the temperature difference between the seawater and the LNG before the gasification and thus can be added to the direct expansion technique. Together the total efficiency is in the order of 8%

The present disclosure provides a solution that uses the expansion along with the gasification of the LNG to accelerate the HTL and generate power. In this scenario, the LNG, liquefied Hydrogen, Ammonia, or other liquefied gas is mixed with HTL such as water at room temperature in the mixing chamber. The LNG is heated isochorically, vaporized as bobbles, and the pressure increases to the vapor pressure, or close to the evaporation pressure, at the HTL temperature. Optionally, the LNG pressure before evaporation is increased to 300 Bar, 140 Bar, 70 Bar, or any other value, which increases the power extraction and the efficiency. Optionally, the liquified gas is heated isobarically or between isochoric and isobaric heating. This pressure is converted to kinetic energy at the outlet of the nozzle when the gas expands isothermally due to its thermal contact with the HTL. The natural gas or Hydrogen, Ammonia, or any other re-gasified gas, is separated from the HTL via gravity, collected and transferred to the gas pipe to be delivered to the consumers. Optionally, this gas pipe is at 140 Bar, 70 Bar, or other value. In that case the output pressure of the at the nozzle is optionally at that pressure.

The HTL is cooled along with the evaporation of the gas and its isothermal expansion. For example, the latent heat of Natural gas (Methane) ~510 Kj/Kg, and the phase diagram of water and methane shows >30 MPa (300 Bar) pressure at 300K and has molar volume of 22.5 cm3/mol. Similarly, the latent heat of Hydrogen is ~450 Kj/Kg, and its phase diagram show >250 MPa (250 Bar) pressure at 300K. The amount of heat that is extracted from the HTL is the enthalpy energy (1.45 MJ/Kg) including the latent heat plus the heat capacity times the temperature difference. Calculating the amount of work, $\dot{W}$, that can be produced while the end pressure is 70 Bar:

Taking Methane density in 1 Bar to be $\rho=0.657$ Kg/m$^3$. For isothermal expansion from 300 Bar;

$$\dot{W} = P\dot{V}\ln(P) = 300Bar * \frac{1\ \text{kg}}{300 * 0.657\frac{\text{Kg}}{\text{m}^3}} * \ln\left(\frac{300}{70}\right) = 0.22\ \text{Mj/Kg}.$$

The HTL is optionally sea water, that is constantly replaced before freezing. Optionally, the HTL is tap water or other liquid that flows in a closed loop and passes through a heat exchanger for reheating. Optionally the closed-loop HTL is a liquid with a low freezing point such as Alcohol, methanol, or other organic material having a liquid phase at LNG temperature and pressure operating range. Optionally, after cooling at the nozzle, the HTL is used to operate a heat engine (on the cold side). For example, the cooled Alcohol exiting the nozzle is optionally used to isothermally compress air for a heat engine. The cold HTL is optionally used for refrigeration or air conditioning. Optionally, seawater is used to heat the HTL through the heat exchanger. Optionally the HTL is heated by burning a small portion of the gas.

Figure 11:
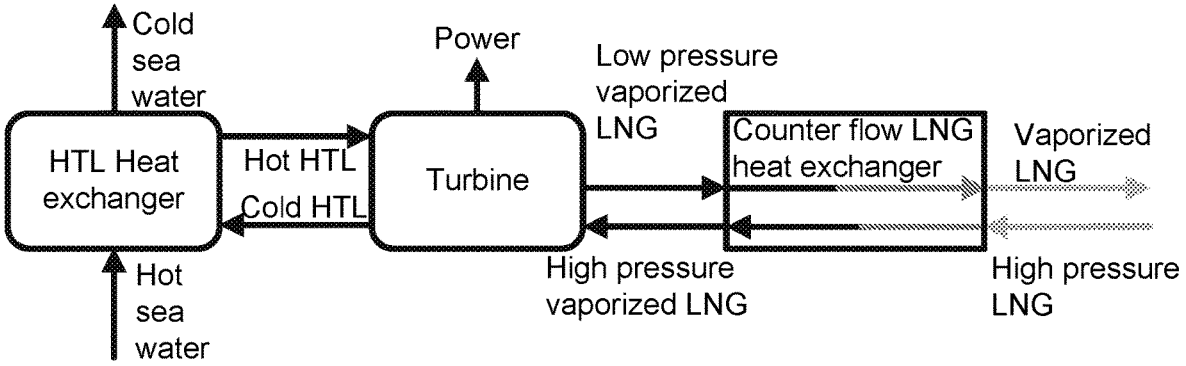
FIG. 11 is a block diagram of a non-limiting example of an embodiment of the system for converting evaporation energy of LNG to work.

FIG. 11 depicts the method for operating the HTL/LNG mixed turbine. LNG or other liquified gas enters the LNG heat exchanger vaporizes and expands isobarically. As a gas, it enters the turbine, mixed with the HTL in the nozzle, and isothermally expands at the HTL approximate temperature. The expansion of the mixed HTL and gas accelerates the HTL, generates thrust, rotates the turbine, and generates work. The exiting gas is approximately at the HTL temperature and at ambient pressure. Optionally, the end pressure is not ambient but is at the required pressure in the pipe that transports the gas, which may be at 6 Bar, 40 Bars, 70 Bars, 140 Bars, or any other value. The vaporized natural gas ejected from the turbine returns through the heat exchanger to vaporize isobarically the LNG. Optionally, the gas does not return to the LNG heat exchanger, and the LNG heat exchanger vaporizes the LNG using an external heat source such as seawater. In this option, the LNG heat exchanger is a pipe that is dipped in seawater. Optionally other heat sources can vaporize the LNG, such as burning a small portion of the gas.

Optionally, there is no LNG heat exchanger, and the LNG is directly flowing (as a liquid) into the turbine and mixes with the HTL in the nozzle where it evaporates and expands isothermally. The vaporized gas is optionally heated isochorically by injecting the LNG in a narrow section of the nozzle, where the HTL velocity is high and the static pressure is low. This streams the LNG as a liquid from the mixing chamber before heating, which occurs at a broader section where the pressure is higher. Matching the broadening rate of the cross-section and the rate of increased pressure in the nozzle with the heating rate induces isochoric heating of the LNG. Optionally, the heating is quasi-isochorically and the buildup pressure in the nozzle is lower than the liquid-vapor phase change pressure at the HTL temperature. Optionally, the buildup pressure is higher than 10%, 20%, or 50% from the liquid-vapor phase change pressure at the HTL temperature.

The HTL is cooled by the latent heat and isothermal expansion. After a single or a few cycles in the turbine, the HTL temperature drops and the HTL needs to be re-heated. Optionally the HTL is re-heated in a heat exchanger (HTL heat exchanger in the figure) by seawater. Optionally tap water or other liquid is used to heat the HTL. Optionally the cold HTL exits the HTL heat exchanger at a colder temperature, which is used for refrigeration or air conditioning.

In the nozzle, the LNG, liquified Hydrogen, Ammonia or other gas is optionally injected as a liquid into the nozzle. This requires thermally insulated LNG pipes to reach the mixing chamber as a liquid. This is exemplified by FIG. 3 and is also explained above. The liquified gas flows in insulating pipes and is injected into the narrow mixing chamber. The HTL velocity is optionally sufficiently high to carry the LNG to the broadened cross-section area where the pressure increases before the evaporation of the LNG. In that section, the HTL pressure increased due to the broadening cross-section. The LNG mixed with the HTL vaporizes and expands isothermally, or quasi-isothermally. Optionally the gas temperature when exiting the nozzle is similar to the HTL temperature. Optionally, the LNG temperature is lower than the HTL temperature by 1%, 10%, or 20% when measured in Kelvin.

Optionally, the LNG is vaporized before it is mixed with the HTL. Optionally a pre-compression of the LNG (in the liquid phase) is performed to the level of the LNG vapor pressure at the HTL temperature. Optionally the pre-compression of the LNG is to the pressure level of the gas in the existing pipe from the turbine. Optionally this pressure is the desired gas pressure in the pipe that can be 140 Bar, 70 Bar, 6 Bar, or any other value. Optionally the gas expands isochorically or semi-isochorically in the nozzle. Optionally the pressure in the nozzle exceeds 10% of the evaporation pressure of the liquified gas at the HTL temperature. Optionally this value exceeds 20%, 50% or 90%. Optionally, the nozzle doesn't have a broadening cross-section after the mixing chamber.

Optionally, the desired gas pressure in the pipe is 140 Bar, 70 Bar, 40 Bar, 6 Bars, or any other value. Optionally, the difference between the vapor pressure of the LNG to the pipe pressure is converted to work through isothermal expansion of the evaporated LNG in the nozzle. For this, the HTL turbine optionally is maintained at a pressure that is equal to or above the pipe operating pressure.

Figure 12:
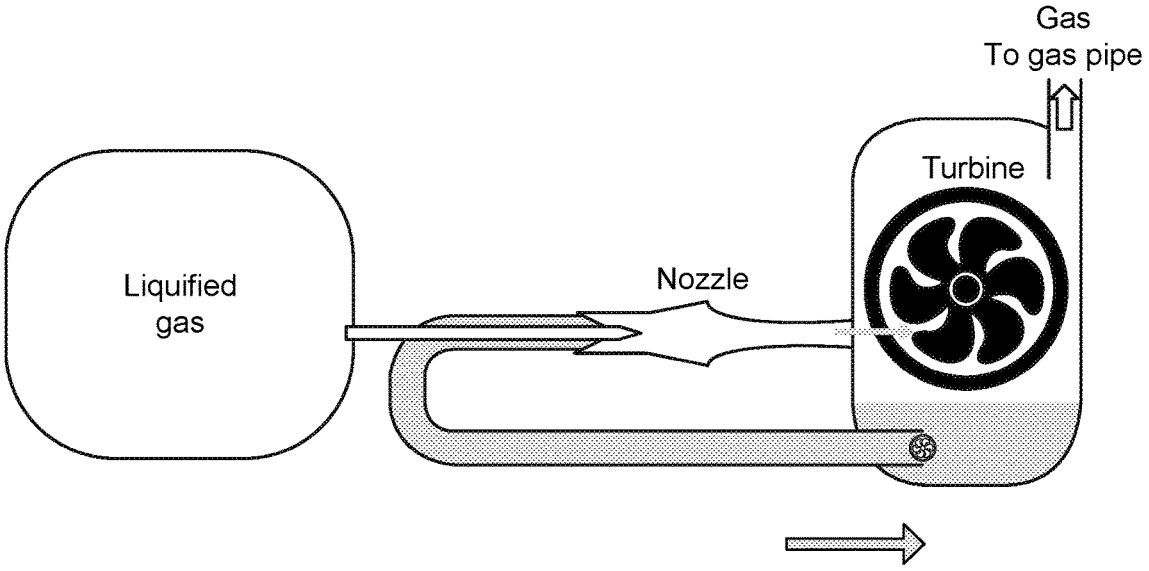
FIG. 12 is a schematic illustration of a non-limiting example of an embodiment of the system according to an aspect of the present disclosure.

FIG. 12 depicts an impulse HTL-gas turbine including an HTL reservoir, a HTL pump that pumps HTL into the nozzle. Liquified gas, such as Hydrogen flows as a liquid into the nozzle where it mixes with the HTL, evaporates, and expands isothermally. This, in turn, accelerates the HTL which rotates the turbine and generates electricity.

Figure 13:
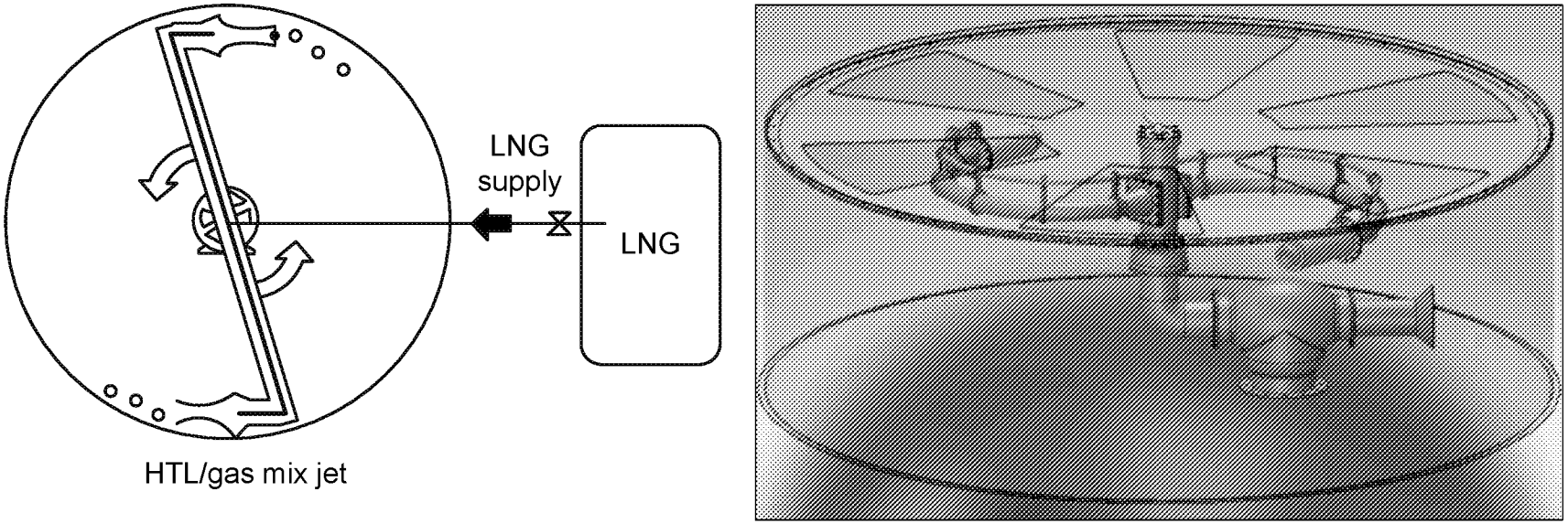
FIG. 13 is a schematic illustration of a non-limiting example of an embodiment of the system according to an aspect of the present disclosure.

FIG. 13 shows a reaction turbine configuration, where the LNG is fed into the rotating nozzles. An electric motor is driven by the thrust the nozzles create, generating electricity. The HTL returns to the drain where it is sucked back to the turbine by centrifugal forces. The level of the HTL in the drain is lower than the nozzles, to avoid impact between the HTL and the turbine, but sufficiently high to avoid discontinuity in the HTL flow into the turbine.

It is noted that portion of the LNG boils as part of the transportation and storage due to small thermal insulation problems. Such boil of gas (BOG) can be several percentages from the total LNG capacity. This BOG is optionally entering the nozzle mixes with the HTL and expands isothermally in the nozzle.

The invention claimed is:

1. A method for converting heat into work, comprising:

vaporizing or bringing a liquid vapor phase-changing material (LVPhC), selected from a list consisting of: pentane, isobutane, propane, R134a, R245fa, fluorocarbons and toluene or any vapors used in organic Rankine Cycle (ORC) technology, from a liquid phase to a vapor phase or a supercritical phase at a temperature of about T1 and a pressure of about P1 and mixing it in a nozzle with a heat transfer liquid (HTL) having a temperature of about T1 and a pressure of about P1, wherein the LVPhC is at a liquid phase below a temperature of about TO in pressure of about P1, wherein TO is lower than T1, thereby resulting in a quasi-isothermal expansion, while reducing the pressure to P0, causing an acceleration of the HTL/LVPhC mixture; and ejecting the accelerated HTL/LVPhC mixture through the nozzle for converting its kinetic energy into work and collecting the LVPhC and the HTL at a pressure of P0; wherein said nozzle is connected to or part of a reaction turbine;

wherein the method further comprises following said collecting:

heating at least a portion of the HTL to a temperature of about T1 and increasing its pressure to a pressure P1 to allow an additional cycle of said mixing;

wherein said ejecting results in the rotation of the nozzle, said rotation of the nozzle causes the generation of the work from the kinetic energy.

2. The method of claim 1, wherein said collecting the LVPhC vapor comprises separating the LVPhC/HTL mixture.

3. The method of claim 1, wherein the method further comprises following said collecting: cooling and increasing the pressure of the LVPhC to obtain liquified LVPhC at a pressure of about P1 and a temperature of about T0 to allow an additional cycle of said mixing;

wherein said cooling comprises passing the vaporized LVPhC through a heat exchanger to exchange heat with the liquified LVPhC, wherein the liquified LVPhC enters the heat exchanger at an entrance temperature of about T0;

wherein said passing comprises maintaining the majority of the liquified LVPhC in a liquid phase.

4. The method of claim 3, wherein said cooling and increasing comprises condensing the vaporized LVPhC prior to increasing its pressure.

5. The method of claim 1, wherein the method further comprises following said collecting: condensing the LVPhC and then passing it through a heat exchanger to exchange heat with the collected vaporized LVPhC to obtain heated liquified LVPhC, wherein the method further comprises increasing the pressure of the heated LVPhC to about P1.

6. The method of claim 1, wherein said vaporizing comprises directing a portion of the collected HTL to exchange heat with the liquified LVPhC, wherein said directing is carried out prior to said heating, wherein said increasing the HTL pressure is carried out prior to said directing, and said heating is carried out following said directing.

7. The method of claim 3, wherein following said cooling and increasing, the method further comprises heating the LVPhC by a LVPhC heat source from a temperature of about T0 to a temperature between T0 and T1.

8. The method of claim 1, wherein said mixing and said vaporizing are carried out simultaneously.

9. The method of claim 1, wherein the HTL is selected from a list consisting of: molten salt, thermal oil, water, salty water, Ethylene glycol.

10. The method of claim 1, wherein the LVPhC is pentane.

11. The method of claim 1, wherein said nozzle supports a supersonic flow.

12. The method of claim 1, wherein the jet ejected from the nozzle is channeled to form a film flow under centrifugal forces.

13. The method of claim 1, wherein said vaporizing or bringing comprises bringing said LVPhC to a supercritical phase.

14. A system for converting heat into work, comprising:

an evaporator for receiving a liquified vapor phase-changing material (LVPhC), selected from a list consisting of: pentane, isobutane, propane, R134a, R245fa, fluorocarbons and toluene or any vapors used in organic Rankine Cycle (ORC) technology, and vaporizing it or bringing to a vapor phase or a supercritical phase at a pressure of about P1 and a temperature of about T1;

a heating volume for heating heat transfer liquid (HTL) to a temperature of about T1;

a HTL pump for increasing pressure of said HTL to a pressure of about said P1;

a nozzle in fluid communication with the HTL pump and the evaporator and having an inlet portion for receiving said HTL and a mixing portion for (i) allowing mixing said HTL at about said temperature T1 and at about said pressure P1 with said LVPhC at a vapor phase and (ii) allowing said mixture to undergo isothermal expansion to a pressure of about P0 lower than said pressure P1, thereby causing acceleration of said mixture at said nozzle towards an outlet of the nozzle;

a reaction turbine configured for rotation in result to the acceleration of said mixture, thereby converting the kinetic energy of the mixture to work, wherein the nozzle is coupled to or part of the reaction turbine; and a separation unit for separating the ejected HTL and the vaporized LVPhC, said separation unit comprises a collection unit to collect the ejected HTL and to allow to direct it to either the heating volume, the HTL pump, the nozzle, the evaporator or any combination thereof;

wherein the collection unit defines a drain for accumulating the separated HTL, and the HTL is suctioned from the drain into the nozzle in result to the operation of the reaction turbine, thereby constituting said HTL pump, wherein the suctioning causes the HTL to enter the nozzle at a pressure of about P1;

wherein the system further comprises a condenser for receiving said separated vaporized LVPhC and condense it to a liquid state; a LVPhC pump downstream said condenser for increasing the pressure of the condensed LVPhC; wherein the condenser comprises or a part thereof constitutes the LVPhC pump;

wherein the system further comprises a LVPhC heat source downstream said condenser to heat the LVPhC to a temperature below or about equal to a vaporization temperature of the LVPhC at pressure of about P1;

wherein the evaporator is in fluid communication with said collection unit for receiving at least a portion of the collected ejected HTL to exchange heat with the liquified LVPhC received in the evaporator to thereby vaporize the liquified LVPhC;

wherein the evaporator is in fluid communication with the heating volume for streaming the HTL following heat exchanging with the liquified LVPhC in the evaporator;

wherein the HTL pump is downstream the nozzle and upstream the evaporator;

wherein a portion of the HTL is streamed from the HTL pump to the evaporator and a portion of the HTL is streamed from the HTL to the nozzle;

wherein at least a part of the mixing portion constitutes said evaporator.

15. The system of claim 14, comprising one of the following:

(i) a heat exchanger in fluid communication with any one of: (1) the separation unit for receiving said ejected vaporized LVPhC into a heat removal portion of the heat exchanger, (2) condenser for streaming the vaporized LVPhC discharged from the heat removal portion thereto, (3) the LVPhC pump for receiving the liquified LVPhC discharged from the LVPhC pump into a heat receiving portion of the heat exchanger, and (4) the evaporator for streaming the liquified LVPhC discharged from the heat receiving portion; or (ii) a heat exchanger in fluid communication with any one of: (1) the separation unit for receiving said ejected vaporized LVPhC into a heat removal portion of the heat exchanger, (2) condenser for streaming the vaporized LVPhC discharged from the heat removal portion thereto and for receiving the liquified LVPhC therefrom into a heat receiving portion of the heat exchanger, (3) the LVPhC pump for streaming the liquified LVPhC discharged from the heat receiving portion into the LVPhC pump; wherein the evaporator is configured to receive the liquified LVPhC from the LVPhC pump.

16. The system of claim 14, wherein the HTL is selected from a list consisting of: molten salt, thermal oil, water, salty water, Ethylene glycol;

wherein the LVPhC is pentane.

17. The system of claim 14, wherein the condenser and the LVPhC pump are constituted by a nozzle that comprises a nozzle inlet for receiving nozzle heat transfer liquid (HTL) stream into the nozzle, an outlet, a suction compressible fluid inlet and an arrangement of fluid manipulation sections arranged in fluid communication in a cascaded fashion and defining a flow path of said fluid;

wherein the arrangement comprises:

a first fluid manipulation section downstream to the nozzle inlet and upstream the second fluid manipulation section, or that a proximal end thereof constitutes the nozzle inlet and having a narrowing configuration in a direction of said flow path for reducing pressure of the nozzle HTL streamed thereinto below pressure of suction fluid in the suction fluid source, and for accelerating flow of said nozzle HTL stream, wherein the suction fluid is said LVPhC at a gas or vapor phase and at about pressure P0;

a second fluid manipulation section having an expanding configuration in the direction of said flow path for receiving the nozzle HTL at a pressure below pressure of the suction fluid, wherein said suction fluid inlet is configured for allowing suction fluid communication between the ambient or the suction fluid source, and said second fluid manipulation section to allow introduction of suction fluid thereinto to be mixed with the nozzle HTL to thereby obtain fluid mixture, said expanding configuration of said second fluid manipulation section is designed for bringing the two-phase mixture to supersonic velocity at least at a distal end thereof;

a third fluid manipulation section having a narrowing configuration in the direction of said flow path for decelerating flow of fluid mixture received from said second fluid manipulation section to sonic or subsonic velocity, and for increasing pressure of said two-phase mixture flowing along said third fluid manipulation section;

a fourth fluid manipulation section having an expanding configuration in the direction of said flow path and configured for increasing pressure of fluid mixture subsonic flow received from the third fluid manipulation section to a pressure above ambient pressure;

wherein said outlet is downstream the fourth fluid manipulation section or is constituted by a distal end thereof and is for discharging the fluid mixture received from the fourth fluid manipulation section, wherein the fluid mixture discharged from the outlet comprises pressurized suction fluid.

18. A method for converting heat into work, comprising:

vaporizing or bringing a liquid vapor phase-changing material (LVPhC), selected from a list consisting of: pentane, isobutane, propane, R134a, R245fa, fluorocarbons and toluene or any vapors used in organic Rankine Cycle (ORC) technology, from a liquid phase to a vapor phase or a supercritical phase at a temperature of about T1 and a pressure of about P1 and mixing it in a nozzle with a heat transfer liquid (HTL) having a temperature of about T1 and a pressure of about P1, wherein the LVPhC is at a liquid phase below a temperature of about T0 in pressure of about P1, wherein T0 is lower than T1, thereby resulting in a quasi-isothermal expansion, while reducing the pressure to P0, causing an acceleration of the HTL/LVPhC mixture; and ejecting the accelerated HTL/LVPhC mixture through the nozzle for converting its kinetic energy into work and collecting the LVPhC and the HTL at a pressure of P0; wherein said nozzle is connected to or part of a reaction turbine;

wherein the method further comprises following said collecting:

heating at least a portion of the HTL to a temperature of about T1 and increasing its pressure to a pressure P1 to allow an additional cycle of said mixing;

wherein said vaporizing comprises directing a portion of the collected HTL to exchange heat with the liquified LVPhC, wherein said directing is carried out prior to said heating, wherein said increasing the HTL pressure is carried out prior to said directing, and said heating is carried out following said directing.

19. A method for converting heat into work, comprising:

vaporizing or bringing a liquid vapor phase-changing material (LVPhC), selected from a list consisting of: pentane, isobutane, propane, R134a, R245fa, fluorocarbons and toluene or any vapors used in organic Rankine Cycle (ORC) technology, from a liquid phase to a vapor phase or a supercritical phase at a temperature of about T1 and a pressure of about P1 and mixing it in a nozzle with a heat transfer liquid (HTL) having a temperature of about T1 and a pressure of about P1, wherein the LVPhC is at a liquid phase below a temperature of about T0 in pressure of about P1, wherein T0 is lower than T1, thereby resulting in a quasi-isothermal expansion, while reducing the pressure to P0, causing an acceleration of the HTL/LVPhC mixture; and ejecting the accelerated HTL/LVPhC mixture through the nozzle for converting its kinetic energy into work and collecting the LVPhC and the HTL at a pressure of P0; wherein said nozzle is connected to or part of a reaction turbine;

wherein the method further comprises following said collecting:

heating at least a portion of the HTL to a temperature of about T1 and increasing its pressure to a pressure P1 to allow an additional cycle of said mixing;

wherein said vaporizing or bringing comprises bringing said LVPhC to a supercritical phase.

20. A system for converting heat into work, comprising:

an evaporator for receiving a liquified vapor phase-changing material (LVPhC), selected from a list consisting of: pentane, isobutane, propane, R134a, R245fa, fluorocarbons and toluene or any vapors used in organic Rankine Cycle (ORC) technology, and vaporizing it or bringing to a vapor phase or a supercritical phase at a pressure of about P1 and a temperature of about T1;

a heating volume for heating heat transfer liquid (HTL) to a temperature of about T1;

a HTL pump for increasing pressure of said HTL to a pressure of about said P1;

a nozzle in fluid communication with the HTL pump and the evaporator and having an inlet portion for receiving said HTL and a mixing portion for (i) allowing mixing said HTL at about said temperature T1 and at about said pressure P1 with said LVPhC at a vapor phase and (ii) allowing said mixture to undergo isothermal expansion to a pressure of about P0 lower than said pressure P1, thereby causing acceleration of said mixture at said nozzle towards an outlet of the nozzle;

a reaction turbine configured for rotation in result to the acceleration of said mixture, thereby converting the kinetic energy of the mixture to work, wherein the nozzle is coupled to or part of the reaction turbine; and a separation unit for separating the ejected HTL and the vaporized LVPhC, said separation unit comprises a collection unit to collect the ejected HTL and to allow to direct it to either the heating volume, the HTL pump, the nozzle, the evaporator or any combination thereof;

wherein the collection unit defines a drain for accumulating the separated HTL, and the HTL is suctioned from the drain into the nozzle in result to the operation of the reaction turbine, thereby constituting said HTL pump, wherein the suctioning causes the HTL to enter the nozzle at a pressure of about P1;

wherein the system further comprises a condenser for receiving said separated vaporized LVPhC and condense it to a liquid state; a LVPhC pump downstream said condenser for increasing the pressure of the condensed LVPhC; wherein the condenser and the LVPhC pump are constituted by a nozzle that comprises a nozzle inlet for receiving nozzle heat transfer liquid (HTL) stream into the nozzle, an outlet, a suction compressible fluid inlet and an arrangement of fluid manipulation sections arranged in fluid communication in a cascaded fashion and defining a flow path of said fluid;

wherein the arrangement comprises:

a first fluid manipulation section downstream to the nozzle inlet and upstream the second fluid manipulation section, or that a proximal end thereof constitutes the nozzle inlet and having a narrowing configuration in a direction of said flow path for reducing pressure of the nozzle HTL streamed thereinto below pressure of suction fluid in the suction fluid source, and for accelerating flow of said nozzle HTL stream, wherein the suction fluid is said LVPhC at a gas or vapor phase and at about pressure P0;

a second fluid manipulation section having an expanding configuration in the direction of said flow path for receiving the nozzle HTL at a pressure below pressure of the suction fluid, wherein said suction fluid inlet is configured for allowing suction fluid communication between the ambient or the suction fluid source, and said second fluid manipulation section to allow introduction of suction fluid thereinto to be mixed with the nozzle HTL to thereby obtain fluid mixture, said expanding configuration of said second fluid manipulation section is designed for bringing the two-phase mixture to supersonic velocity at least at a distal end thereof;

a third fluid manipulation section having a narrowing configuration in the direction of said flow path for decelerating flow of fluid mixture received from said second fluid manipulation section to sonic or subsonic velocity, and for increasing pressure of said two-phase mixture flowing along said third fluid manipulation section;

a fourth fluid manipulation section having an expanding configuration in the direction of said flow path and configured for increasing pressure of fluid mixture subsonic flow received from the third fluid manipulation section to a pressure above ambient pressure;

wherein said outlet is downstream the fourth fluid manipulation section or is constituted by a distal end thereof and is for discharging the fluid mixture received from the fourth fluid manipulation section, wherein the fluid mixture discharged from the outlet comprises pressurized suction fluid.

* * * * *